US007087897B2

(12) United States Patent
Bateman et al.

(10) Patent No.: US 7,087,897 B2
(45) Date of Patent: Aug. 8, 2006

(54) MASS SPECTROMETER

(75) Inventors: Robert Harold Bateman, Knutsford (GB); Jeff Brown, Cheshire (GB)

(73) Assignee: Waters Investments Limited, New Castle, DE (US)

( * ) Notice: Subject to any disclaimer, the term of this patent is extended or adjusted under 35 U.S.C. 154(b) by 122 days.

(21) Appl. No.: 10/797,242

(22) Filed: Mar. 10, 2004

(65) Prior Publication Data

US 2004/0232327 A1 Nov. 25, 2004

Related U.S. Application Data

(60) Provisional application No. 60/453,518, filed on Mar. 12, 2003.

(51) Int. Cl.
*H01J 49/40* (2006.01)

(52) U.S. Cl. ..... 250/287

(58) Field of Classification Search ..... 250/287, 250/281, 282, 396 R
See application file for complete search history.

(56) References Cited

U.S. PATENT DOCUMENTS

| | | | | |
|---|---|---|---|---|
| 5,464,985 | A * | 11/1995 | Cornish et al. | 250/396 R |
| 6,770,872 | B1 * | 8/2004 | Bateman et al. | 250/281 |
| 6,794,640 | B1 * | 9/2004 | Bateman et al. | 250/281 |
| 6,900,430 | B1 * | 5/2005 | Okumura et al. | 250/281 |
| 2002/0030159 | A1 | 3/2002 | Chernushevich et al. | 250/287 |

FOREIGN PATENT DOCUMENTS

| | | |
|---|---|---|
| GB | 2388 248 | 11/2003 |
| GB | 2 392 006 | 2/2004 |
| GB | 2 394 356 | 4/2004 |

* cited by examiner

*Primary Examiner*—Kiet T. Nguyen
(74) *Attorney, Agent, or Firm*—Anthony J Janiuk; Jamie H. Rose

(57) ABSTRACT

A mass spectrometer is disclosed comprising an electric field region $L_2$ wherein a time-varying electric field is applied thereto. In a mode of operation a pulse of ions 3 comprising ions having different mass to charge ratios passes through the electric field region $L_2$ and the electric field is varied with time such that at least some of the ions 3 having different mass to charge ratios subsequently arrive at the extraction or acceleration region 10 of a Time of Flight mass analyser at substantially the same time.

78 Claims, 11 Drawing Sheets

MASS SPECTROMETER

CROSS REFERENCE TO RELATED APPLICATIONS

This application claims priority from United Kingdom patent applications GB-0305541.5, filed 11 Mar. 2003, GB-0323461.4, filed 7 Oct. 2003 and U.S. Provisional Application No. 60/453,518, filed 12 Mar. 2003. The contents of these applications are incorporated herein by reference.

FIELD OF THE INVENTION

STATEMENT ON FEDERALLY SPONSORED RESEARCH N/A

The present invention relates to a mass spectrometer and a method of mass spectrometry.

BACKGROUND OF THE INVENTION

An orthogonal acceleration Time of Flight mass analyser in combination with an Electrospray ion source is known. It is known to measure the flight time of ions through a flight region of the orthogonal acceleration Time of Flight mass analyser. As the flight region is arranged perpendicular to the axis along which ions enter the orthogonal acceleration Time of Flight mass analyser, the time of flight measurements through the flight region are substantially unaffected by variations in the axial velocity of the ions. The decoupling of the axial velocity of the ions from the time of flight measurement results in higher mass measurement accuracy and a higher mass resolving power compared with axial Time of Flight mass analysers used in conjunction with pulsed ion sources such as, for example, Matrix Assisted Laser Desorption Ionisation ("MALDI") ion sources.

One disadvantage, however, of using an orthogonal acceleration Time of Flight mass analyser is that the duty cycle for sampling a continuous ion beam in a MS mode of operation is relatively limited in that between 75% and 90% of the ions in the continuous ion beam are not extracted and hence are not orthogonally accelerated from the ion beam. Accordingly, these ions are lost to the system and this reduces the overall sensitivity of the orthogonal acceleration Time of Flight mass analyser and also results in relatively poor detection limits.

When a pulsed ion source, such as a Matrix Assisted Laser Desorption Ionisation ("MALDI") ion source, is used in conjunction with an orthogonal acceleration Time of Flight mass analyser the ion loss tends to be even worse. The ions generated by a MALDI ion source will tend to have substantially the same ion energy irrespective of their mass to charge ratio and hence ions will tend to be emitted from the MALDI ion source at velocities which are inversely proportional to the square root of the mass to charge ratio of the ions. Accordingly, the ions generated from a MALDI ion source will tend to become spread out and will become temporally dispersed according to their mass to charge ratio as they exit the ion source. This temporal dispersion of ions according to their mass to charge ratio coupled with the limitation that the extraction or acceleration region of an orthogonal acceleration Time of Flight mass analyser can only sample a fraction of an ion beam entering the mass analyser at any one particular point in time results in only a portion of the total mass to charge ratio range of ions entering the orthogonal acceleration Time of Flight mass analyser being sampled in each extraction pulse.

A known approach which attempts to address this problem is to use a relatively low kinetic energy ion source (e.g. less than 100 eV) and to collisionally cool the ions. This process effectively transforms a pulse of ions into a pseudo-continuous beam of ions which is more suited for use with an orthogonal acceleration Time of Flight mass analyser. However, this approach is not completely effective since the pulse of ions is not transformed into a truly continuous beam. Collisional cooling of the ions can also cause problems since the collision gas may react with the analyte ions and form chemical adduct ions. Furthermore, the matrix used with MALDI ion sources tends to generate a significant amount of chemical noise which reduces the ion detection limit.

A known arrangement comprising a MALDI ion source, a collision or fragmentation cell and an orthogonal acceleration Time of Flight mass spectrometer has, however, been found to be advantageous when the mass spectrometer is operated in a MS/MS mode of operation. Ions accelerated with constant energy from the ion source will travel with velocities inversely proportional to the square root of their mass to charge ratio. In a MS mode of operation only ions having substantially the same mass to charge ratio or ions having a relatively narrow range of mass to charge ratios will arrive at the extraction or acceleration region of the orthogonal acceleration Time of Flight mass analyser at substantially the same time and hence will be pulsed into the flight region of the mass analyser. In contrast in a MS/MS mode of operation fragment ions formed, for example, in a collision cell downstream of the ion source and upstream of the orthogonal acceleration Time of Flight extraction or acceleration region will have substantially the same velocity as that of their corresponding parent ions. Accordingly, in a MS/MS mode of operation all the fragment ions of a particular parent ion will arrive at the extraction or acceleration region of an orthogonal acceleration Time of Flight mass analyser together with any corresponding unfragmented parent ions at substantially the same time. The time at which the fragment ions will arrive at the extraction or acceleration region will also be substantially the same time that the corresponding parent ion would have arrived at the extraction or acceleration region if the corresponding parent ion had not fragmented. Therefore, the mass spectra recorded when the mass spectrometer is operated in a MS/MS mode of operation will advantageously include just a narrow range of parent ions and all the fragment ions from those particular parent ions.

It is desired to provide an improved mass spectrometer and in particular to provide a mass spectrometer which enables a pulsed ion source to be operated efficiently in conjunction with a Time of Flight mass analyser in a MS mode of operation.

It is also desired to provide a mass spectrometer which has a high duty cycle in a MS mode of operation.

SUMMARY

According to an aspect of the present invention there is provided a mass spectrometer comprising a first electric field region and a Time of Flight mass analyser comprising an extraction or acceleration region. In a mode of operation a group of ions having substantially different mass to charge ratios is arranged to pass through the first electric field region, wherein a first electric field which varies with time is applied across at least a portion of the first electric field region such that at least some ions having substantially different mass to charge ratios are arranged to arrive at the extraction or acceleration region at substantially the same first time.

At least 5%, 10%, 15%, 20%, 25%, 30%, 35%, 40%, 45%, 50%, 55%, 60%, 65%, 70%, 75%, 80%, 85%, 90%, 95% or substantially 100% of the ions in the group of ions are preferably arranged to arrive at the extraction or acceleration region at substantially the same first time.

In a preferred embodiment the group of ions have a range of mass to charge ratios, wherein the range is preferably at least 10, 50, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900, 2000, 2500, 3000, 3500, 4000, 4500, 5000, 5500, 6000, 6500, 7000, 7500, 8000, 8500, 9000, 9500 or 10000 mass to charge ratio units.

In the preferred embodiment at least 5%, 10%, 15%, 20%, 25%, 30%, 35%, 40%, 45%, 50%, 55%, 60%, 65%, 70%, 75%, 80%, 85%, 90%, 95% or substantially 100% of the ions arriving at the extraction or acceleration region at substantially the same first time are subsequently extracted or accelerated from the extraction or acceleration region.

According to a preferred embodiment in use at least some ions having a first mass to charge ratio enter the first electric field region with a first initial velocity and exit the first electric field region with a first final velocity and wherein in use at least some ions having a second different mass to charge ratio enter the first electric field region with a second initial velocity and exit the first electric field region with a second final velocity, wherein the first initial velocity is greater than the second initial velocity and the first final velocity is less than the second final velocity.

According to a preferred embodiment ions having different mass to charge ratios enter in use the first electric field region with various initial velocities and exit the first electric field region with various final velocities, wherein the ions having the fastest initial velocities are the ions which have the slowest final velocities.

According to a preferred embodiment ions having different mass to charge ratios enter in use the first electric field region with various initial velocities and exit the first electric field region with various final velocities, wherein the ions having the slowest initial velocities are the ions which have the fastest final velocities.

In a particularly preferred embodiment, at least some ions having different mass to charge ratios enter the first electric field region with a first range of velocities and exit the first electric field region with a second range of velocities, wherein the second range of velocities is substantially smaller than the first range of velocities.

Ions having a first mass to charge ratio preferably exit the first electric field region before ions having a second mass to charge ratio, wherein the first mass to charge ratio is smaller than the second mass to charge ratio. The first electric field may be arranged to cause ions having a first mass to charge ratio to exit the first electric field region at a first velocity and ions having a second mass to charge ratio to exit the first electric field region at a second velocity. The second mass to charge ratio is preferably greater than the first mass to charge ratio. In a particularly preferred embodiment the second velocity is greater than the first velocity. The second velocity may be <1%, 1–5%, 5–10%, 10–15%, 15–20%, 20–25%, 25–30%, 30–35%, 35–40%, 40–45%, 45–50%, 50–55%, 55–60%, 60–65%, 65–70%, 70–75%, 75–80%, 80–85%, 85–90%, 90–95% or 95–100% greater than the first velocity. According to another embodiment the second velocity may be 100–200%, 200–300%, 300–400%, 400–500%, 500–600%, 600–700%, 700–800%, 800–900%, 900–1000%, 1000–2000%, 2000–3000%, 3000–4000%, 4000–5000%, 5000–6000%, 6000–7000%, 7000–8000%, 8000–9000%, 9000–10000% or >10000% higher than the first velocity.

In an alternative embodiment the second velocity may substantially equal to the first velocity. According to this embodiment ions may be arranged to exit the first electric field region with substantially the same velocity i.e. a source of constant velocity ions is provided.

In an embodiment the first electric field may be arranged to cause undesired ions such as matrix, background or interference ions to arrive at the extraction or acceleration region at a second different time to the desired ions. At least some of the undesired ions arriving at the extraction or acceleration region at the second different time are preferably not then subsequently extracted or accelerated into the extraction or acceleration region i.e. the extraction or acceleration region acts as a mass filter such that undesired ions are lost to the system.

In a preferred embodiment at least some of the ions having substantially different mass to charge ratios arriving at the extraction or acceleration region at substantially the same first time also arrive at substantially the same position or location within the extraction or acceleration region at the same first time.

The first electric field region may be arranged between at least a first electrode and a second electrode, wherein in use the potential of either the first electrode and/or the second electrode may be varied with time. The first and/or second electrode may comprise one or more tubular electrodes and/or one or more plate electrodes and/or one or more grid electrodes. In another embodiment the first electrode and/or the second electrode may comprise one or more annular electrodes, one or more Einzel lens arrangements comprising three or more electrodes, one or more segmented rod sets, one or more quadrupole, hexapole, octapole or higher order rod sets, or a plurality of electrodes having apertures through which ions are transmitted in use.

In a less preferred embodiment the mass spectrometer may comprise one or more electrodes arranged within the first electric field region, wherein in use the potential of at least one of the one or more electrodes is varied with time. The one or more electrodes may comprise one or more tubular electrodes, one or more annular electrodes, one or more Einzel lens arrangements comprising three or more electrodes, one or more segmented rod sets, one or more quadrupole, hexapole, octapole or higher order rod sets, or a plurality of electrodes having apertures through which ions are transmitted in use.

In a particularly preferred embodiment the magnitude of the first electric field is varied with time whilst ions pass through the first electric field region. The magnitude of the first electric field may be increased with time. Alternatively, or in addition, the magnitude of the first electric field may decrease with time. In a preferred embodiment the magnitude of the first electric field varies substantially sinusoidally or cosinusoidally with time. The term "sinusoidally" is preferably used generically to cover any function which varies in a similar manner to a sine or co-sine wave.

In another embodiment the magnitude of the first electric field may vary substantially exponentially with time. According to other slightly less preferred embodiments the magnitude of the first electric field may vary according to other functions with time and may, for example, vary substantially linearly with time, according to a square law ramp function with time, according to a cubic law ramp function with time, according to a power law ramp function with time, according to a quadratic or higher order polynomial function with time or according to a multiple stepped function with time.

The direction of the first electric field is preferably in a direction substantially parallel to the direction of ion travel although in other less preferred embodiments it is contemplated that the electric field could be in other directions. In an embodiment the direction of the first electric field may change whilst ions pass through the first electric field region.

In a preferred embodiment, the length of the first electric field region is less than 1 mm, 1–2 mm, 2–3 mm, 3–4 mm, 4–5 mm, 5–6 mm, 6–7 mm, 7–8 mm, 8–9 mm, 9–10 mm or greater than 10 mm.

According to a particularly preferred embodiment the first electric field acts to decelerate at least some of the ions passing through the first electric field region. Alternatively, or in addition, the first electric field may act to accelerate at least some of the ions passing through the first electric field region.

The preferred mass spectrometer further comprises a first field free region arranged downstream of the first electric field region. The first field free region may be formed by (or provided by or within) one or more tubular electrodes and/or one or more plate electrodes. Alternatively, other electrode arrangements may form the first field free region. The length of the first field free region is preferably ≦50 mm, ≧50 mm, ≧100 mm, ≧150 mm, ≧200 mm, ≧250 mm, ≧300 mm, ≧350 mm, ≧400 mm, ≧450 mm or ≧500 mm.

In a preferred embodiment a collision or fragmentation cell may be provided in the first field free region. Preferably, the collision or fragmentation cell comprises a gas capillary tube or another form of tubular housing preferably having a relatively small bore. The collision or fragmentation cell preferably has a circular, square or rectangular cross-section and preferably ensures that a relatively high pressure gas region is maintained within the collision or fragmentation cell without at the same time leaking too much gas into the differential pumping chamber in which the collision or fragmentation cell is provided. The collision or fragmentation cell preferably does not include any means of radial confinement of the ions i.e. no AC or RF voltages are preferably applied to the collision or fragmentation cell in order to provide radial confinement of ions.

An electrostatic energy analyser and/or a mass filter and/or an ion gate may be arranged upstream and/or downstream of the collision or fragmentation cell. The mass filter may, for example, comprise a magnetic sector mass filter, an RF quadrupole mass filter or a Wien filter.

In a preferred embodiment the mass spectrometer further comprises a second electric field region arranged upstream of the first electric field region, wherein in use a second electric field is maintained across at least a portion of the second electric field region. Preferably, the second electric field remains substantially constant with time whilst ions pass through the second electric field region. However, thereafter the electric field may then increase or vary with time.

The second electric field may cause at least 10%, 20%, 30%, 40%, 50%, 60%, 70%, 80%, 90%, 95% or substantially 100% of ions passing through the second electric field region to exit the second electric field region with substantially the same kinetic energy. Preferably, whilst ions pass through the second electric field region a potential difference is maintained across at least a portion of the second electric field region, wherein the potential difference is <50 V, 50–100 V, 100–150 V, 150–200 V, 200–250 V, 250–300 V, 300–350 V, 350–400 V, 400–450 V, 450–500 V, 500–600 V, 600–700 V, 700–800 V, 800–900 V, 900–1000 V, 1–2 kV, 2–3 kV, 3–4 kV, 4–5 kV or greater than 5 kV.

In a preferred embodiment, the length of the second field region is less than 1 mm, 1–2 mm, 2–3 mm, 3–4 mm, 4–5 mm, 5–6 mm, 6–7 mm, 7–8 mm, 8–9 mm, 9–10 mm or greater than 10 mm.

In one embodiment the second electric field is varied with time whilst ions pass through the second electric field region.

In the preferred embodiment the mass spectrometer further comprises a second field free region arranged upstream of the first electric field region. The second field free region is preferably arranged between the first electric field region and the second electric field region. Preferably, the second field free region is formed by (or provided by or within) one or more tubular electrodes and/or one or more plate electrodes. In the preferred embodiment at least some of the ions passing through the second field free region become spatially and/or temporally separated according to their mass to charge ratio. The length of the second field free region is preferably less than 10 mm, 10–20 mm, 20–30 mm, 30–40 mm, 40–50 mm, 50–60 mm, 60–70 mm, 70–80 mm, 80–90 mm, 90–100 mm or greater than 100 mm.

In the preferred embodiment, the mass spectrometer further comprises an axial DC acceleration lens arranged upstream of the extraction or acceleration region.

The effective extraction or acceleration region according to the preferred embodiment is smaller than conventional arrangements. For example, the effective extraction or acceleration region may be less than 1 mm, 1–2 mm, 2–3 mm, 3–4 mm, 4–5 mm, 5–6 mm, 6–7 mm, 7–8 mm, 8–9 mm, 9–10 mm or greater than 10 mm long. In a preferred embodiment the effective axial length of the extraction or acceleration region is adjustable. The extraction or acceleration region may comprise a plurality of extraction or acceleration electrodes and the effective length of the extraction or acceleration region may be adjusted by varying the number of extraction or acceleration electrodes used to extract or accelerate ions.

The mass spectrometer preferably comprises an adjustable aperture, shutter or beam stop arranged between an extraction or acceleration electrode arranged in the extraction or acceleration region and a drift or flight region arranged downstream of the extraction or acceleration region. In a mode of operation the adjustable aperture, shutter or beam stop substantially prevents or attenuates at least some ions which have been extracted or accelerated by the extraction or acceleration electrode from being transmitted into the drift or flight region. The size, area, diameter, length, width or transmission coefficient of the aperture, shutter or beam stop are preferably adjustable. In use, at least some parent ions are preferably fragmented in a fragmentation or collision cell into fragment ions and wherein fragment ions and their corresponding parent ions exit the fragmentation or collision cell with substantially the same velocity and reach the extraction or acceleration electrode at substantially the same time. In the mode of operation multiple parent ions having different mass to charge ratios and their corresponding fragment ions are extracted or accelerated into the drift or flight region at the same time and the adjustable aperture, shutter or beam stop substantially prevents or attenuates at least some parent ions and their corresponding fragment ions from being transmitted into the drift or flight region whilst substantially permitting or transmitting at least some other parent ions and their corresponding fragment ions into the drift or flight region.

The mass spectrometer may comprise an Electrospray ("ESI") ion source, an Atmospheric Pressure Chemical Ionisation ("APCI") ion source, an Atmospheric Pressure Photo Ionisation ("APPI") ion source, a Laser Desorption Ionisation ("LDI") ion source, an Inductively Coupled Plasma ("ICP") ion source, an Electron Impact ("EI") ion source, a Chemical Ionisation ("CI") ion source, a Field Ionisation ("FI") ion source, a Fast Atom Bombardment ("FAB") ion source, a Liquid Secondary Ion Mass Spectrometry ("LSIMS") ion source, an Atmospheric Pressure Ionisation ("API") ion source or a Field Desorption ("FD") ion source. In a particularly preferred embodiment the mass spectrometer comprises a Matrix Assisted Laser Desorption Ionisation ("MALDI") ion source or a Desorption/Ionisation on Silicon ("DIOS") ion source. The mass spectrometer may comprise either a continuous or a pulsed ion source.

In the preferred embodiment the Time of Flight mass analyser comprises an orthogonal acceleration Time of Flight mass analyser. In an alternative less preferred embodiment, the Time of Flight mass analyser comprises an axial acceleration Time of Flight mass analyser.

From another aspect the present invention provides a method of mass spectrometry comprising providing a first electric field region, providing a Time of Flight mass analyser comprising an extraction or acceleration region and varying a first electric field applied across at least a portion of the first electric field region. The first electric field is varied such that ions having substantially different mass to charge ratios passing through the first electric field region are accelerated and/or decelerated such that ions having substantially different mass to charge ratios arrive at the extraction or acceleration region at substantially the same time.

In the preferred embodiment the magnitude of the first electric field varies with time whilst ions pass through the first electric field region. Preferably, the magnitude of the first electric field increases with time. In another embodiment, the magnitude of the first electric field decreases with time. In a particularly preferred embodiment the magnitude of the first electric field varies substantially sinusoidally or cosinusoidally with time.

According to another aspect of the present invention there is provided a mass spectrometer comprising:

a fragmentation or collision cell;

a Time of Flight mass analyser comprising an extraction or acceleration electrode and a drift or flight region, wherein the extraction or acceleration electrode extracts or accelerates ions in use into the drift or flight region; and an adjustable aperture, shutter or beam stop arranged between the extraction or acceleration electrode and the drift or flight region, wherein in a mode of operation the adjustable aperture, shutter or beam stop substantially prevents or attenuates at least some ions which have been extracted or accelerated by the extraction or acceleration electrode from being transmitted into the drift or flight region.

The Time of Flight mass analyser is preferably an orthogonal acceleration Time of Flight mass analyser.

The size, area, diameter, length, width or transmission coefficient of the aperture, shutter or beam stop is preferably adjustable.

In use preferably at least some parent ions are fragmented in the fragmentation or collision cell into fragment ions and wherein fragment ions and their corresponding parent ions exit the fragmentation or collision cell with substantially the same velocity and reach the extraction or acceleration electrode at substantially the same time. In the mode of operation multiple parent ions having different mass to charge ratios and their corresponding fragment ions are preferably extracted or accelerated into the drift or flight region at the same time and wherein the adjustable aperture, shutter or beam stop substantially prevents or attenuates at least some parent ions and their corresponding fragment ions from being transmitted into the drift or flight region whilst substantially permitting or transmitting at least some other parent ions and their corresponding fragment ions into the drift or flight region.

According to another aspect of the present invention there is provided a method of mass spectrometry comprising:

providing a fragmentation or collision cell, a Time of Flight mass analyser comprising an extraction or acceleration electrode and a drift or flight region, and an adjustable aperture, shutter or beam stop arranged between the extraction or acceleration electrode and the drift or flight region;

extracting or accelerating ions into the drift or flight region; and using the adjustable aperture, shutter or beam stop to substantially prevent or attenuate at least some ions which have been extracted or accelerated by the extraction or acceleration electrode from being transmitted into the drift or flight region.

The Time of Flight mass analyser is preferably an orthogonal acceleration Time of Flight mass analyser.

The preferred mass spectrometer is suitable for being operated in both MS and MS/MS modes of operation and efficiently couples a pulsed ion source to a mass analyser, preferably an orthogonal acceleration Time of Flight mass analyser. The preferred mass spectrometer enables MS and MS/MS mass analysis data to be obtained with high sensitivity, high mass measurement accuracy and high mass resolution compared with conventional arrangements. The preferred mass spectrometer is able to increase the duty cycle of parent ions being accelerated into a Time of Flight region in a MS mode of operation without needing to collisionally cool ions. The preferred embodiment therefore avoids any problems related to the formation of chemical adduct ions which may be formed during collisionally cooling and hence detection limits are improved compared with conventional arrangements.

The preferred embodiment relates to a mass spectrometer having an improved duty cycle in a MS mode of operation compared with conventional mass spectrometers comprising a MALDI ion source and an orthogonal acceleration Time of Flight mass analyser. The preferred embodiment is also able to record MS/MS spectra and may use a controllable shutter or aperture to improve the specificity with which selected parent ions and their corresponding fragment ions are orthogonally accelerated in the drift or flight region of the Time of Flight mass analyser.

According to a particularly preferred embodiment ions are arranged to enter an electric field region which experiences a time varying electric field which may vary sinusoidally with time. The time-varying electric field is preferably arranged to accelerate and/or decelerate at least some of the ions passing through the electric field region such that the ions transmitted through the electric field region are arranged to arrive at an extraction or acceleration region of a Time of Flight mass analyser region at substantially the same time. The electric field is preferably arranged to vary with time such that ions having different mass to charge ratios are accelerated to kinetic energies which optimise the performance of the Time of Flight mass analyser.

The ions are preferably arranged to have slightly different velocities upon exiting the electric field region such that the ions all arrive at the extraction or acceleration region of an orthogonal or less preferably axial acceleration Time of Flight mass analyser at substantially the same time irrespective of the mass to charge ratio or initial velocity of the ions. Preferably, the time-varying electric field applied to the electric field region may be arranged such that ions which pass through and leave the electric field region at a first time are accelerated or decelerated to a slightly slower velocity than ions which subsequently pass through and exit the electric field region at a second slightly later time. In the preferred embodiment a field free region is arranged downstream of the time varying electric field region. In this embodiment, the ions which leave the electric field region at the second slightly later time preferably catch up with ions which previously exited the electric field region at the first time.

According to the preferred embodiment, substantially all of the ions from a pulsed source, such as a Matrix Assisted Laser Desorption Ionisation ("MALDI") ion source, may be transported to the extraction or acceleration region of an orthogonal acceleration Time of Flight mass analyser in a MS mode of operation so that the ions arrive at the extraction or acceleration region at substantially the same time. Advantageously, the duty cycle may be increased in a MS mode of operation to substantially 100% for ions of all mass to charge ratios. Advantageously, in a MS mode of operation very few ions if any are lost to the system. The preferred embodiment therefore represents a significant advance in the art. Preferably, this is achieved by the application of an appropriate time-varying electric field(s) that may be provided in one or more electric field regions arranged close to or, less preferably, actually within the ion source.

Advantageously, the preferred embodiment has the ability to simultaneously record MS/MS mass spectra from multiple parent ions. Fragment ions resulting from the fragmentation of some parent ions by, for example, the process of Post Source Decay ("PSD"), Collision Induced Decomposition ("CID"), Surface Induced Dissociation ("SID") or Electron Capture Dissociation ("ECD") between the ion source and the extraction or acceleration region of an orthogonal acceleration Time of Flight mass analyser will travel at substantially the same velocity as their corresponding parent ions. The fragment ions will therefore arrive at the extraction or acceleration region at substantially the same time as corresponding parent ions. Parent ions having different mass to charge ratios and/or different initial velocities may be subjected to a time-varying electric field such that they arrive at a fragmentation region (i.e. fragmentation cell) at substantially the same time. The Time of Flight mass analyser can then acquire a spectrum of all parent ions and fragment ions with negligible ion loss. According to this embodiment, the time-varying electric field enables parent ions to obtain substantially the same velocity irrespective of the mass to charge ratio and hence the collision energy in the centre of mass frame of reference will be nearly equal for all ions. This is advantageous as in Collision Induced Decomposition ("CID") the collisional energy is better optimised for fragmentation.

According to the preferred embodiment parent ions having different mass to charge ratios may be deliberately arranged to obtain slightly different velocities by the application of the time-varying electric field(s) such that the parent ions arrive at the fragmentation region at substantially the same time. This relatively small spread in ion velocities is preferably substantially smaller than the spread in ion velocities of the parent ions prior to passing through the time-varying electric field region.

DESCRIPTION OF THE DRAWINGS

Various embodiments of the present invention will now be described, by way of example only, and with reference to the accompanying drawings in which.

DETAILED DESCRIPTION OF THE INVENTION

Figure 1:
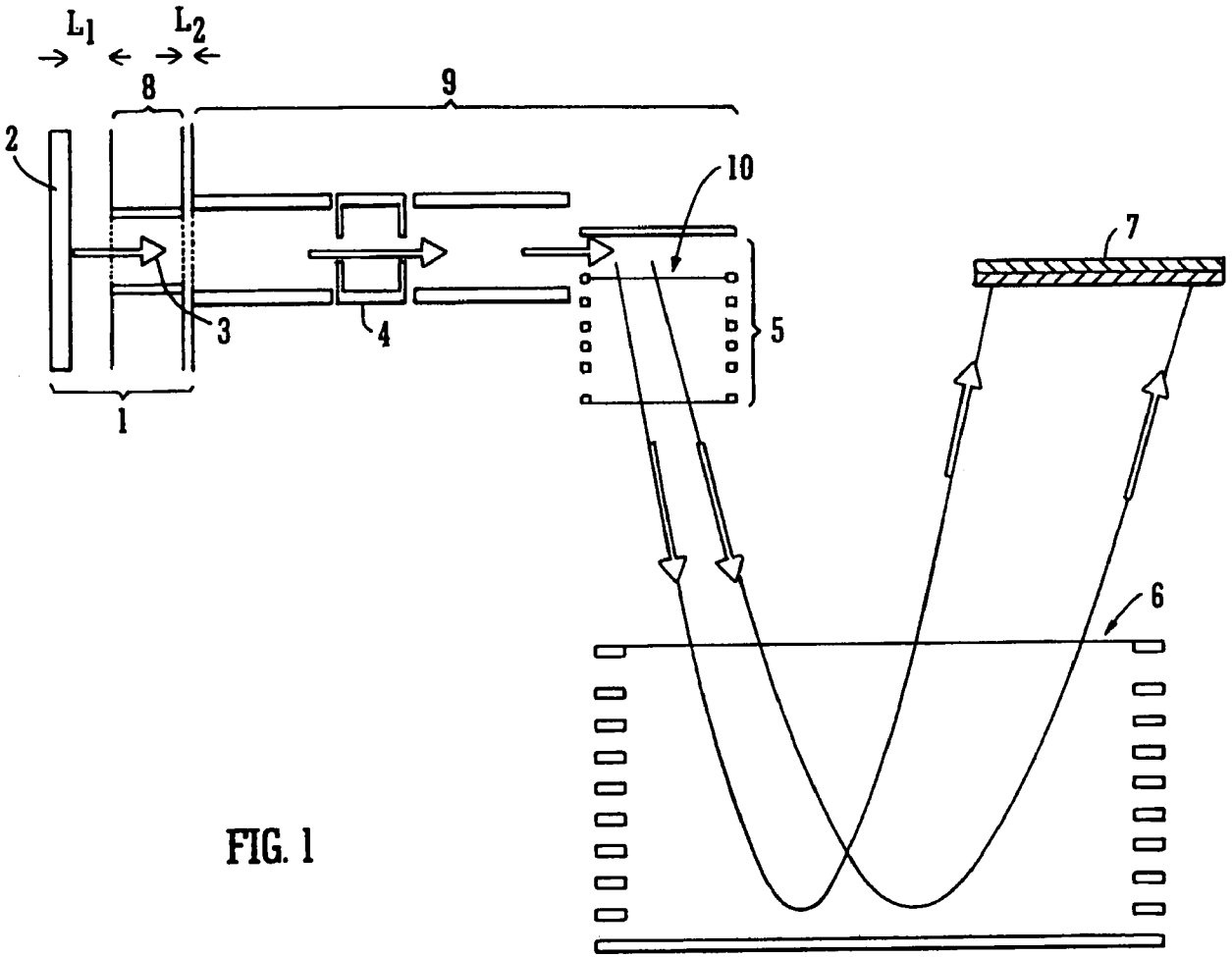
FIG. 1 shows a schematic of a preferred orthogonal acceleration Time of Flight mass analyser.

A preferred embodiment of the present invention will now be described with reference to FIG. 1. FIG. 1 shows a preferred mass spectrometer comprising an orthogonal acceleration Time of Flight mass analyser. The mass spectrometer preferably comprises a Matrix Assisted Laser Desorption Ionisation ("MALDI") ion source 1. Ions 3 may be generated from a target or sample plate 2 of an ion source 1 and preferably pass through two separate electric field regions $L_1$,$L_2$. The electric field regions $L_1$,$L_2$ may be arranged within and/or downstream of the ion source 1.

The initial electric field region $L_1$ is preferably arranged immediately adjacent to the target or sample plate 2. The electric field maintained across the initial electric field region $L_1$ preferably remains substantially constant with time at least until preferably substantially all of the ions 3 have passed through the initial electric field region $L_1$. The electric field in the initial electric field region $L_1$ is preferably arranged to accelerate the ions 3 to a substantially constant energy. The ions 3 are then preferably arranged to enter an initial field free region 8 (or first time of flight region) arranged downstream of the initial electric field region $L_1$. The initial field free region 8 preferably acts as a drift or flight region wherein the ions 3 which pass through the initial field free region 8 are allowed to temporally separate according to their mass to charge ratio. The ions 3 then emerge from the initial field free region 8 at slightly different times and enter a further electric field region $L_2$ arranged downstream of the initial electric field region $L_1$ and the initial field free region 8. The further electric field region $L_2$ is preferably shorter than the initial electric field region $L_1$. An electric field is preferably maintained across the further electric field region $L_2$ and the electric field preferably varies with time whilst ions are transmitted through the further electric field region $L_2$. Ions 3 which enter the further electric field region $L_2$ (at slightly different times) preferably have a range of mass to charge ratios and velocities.

Ions having a relatively high velocity which arrive at the further electric field region $L_2$ before other relatively slower ions will, according to the preferred embodiment, be decelerated (or accelerated) such that these ions will then enter and travel through a subsequent further field free region 9 (or second time of flight region) arranged downstream of the further electric field region $L_2$ with a slightly lower final velocity compared with ions which arrive at the further electric field region $L_2$ at a slightly later time and with a relatively lower velocity. Ions which arrive at the further electric field region $L_2$ at a slightly later time are preferably arranged to be decelerated (or accelerated) such that these ions obtain a final velocity which is preferably slightly higher than the final velocity of the ions which had arrived at the further electric field region $L_2$ at an earlier time and which were the first to enter the further field free region 9. Preferably, the velocity of ions passing through the further electric field region $L_2$ is inverted in the sense that faster ions become relatively slower, and slower ions become relatively faster. According to the preferred embodiment ions which arrive slightly later at the further electric field region $L_2$ are preferably arranged to exit the further electric field region $L_2$ with a velocity which preferably enables them to effectively catch up with ions which had exited the further electric field region $L_2$ before them. According to an embodiment the ions which initially enter the further electric field region $L_2$ may be decelerated relatively severely, whereas the ions which subsequently enter the further electric field region $L_2$ may be decelerated relatively less severely.

According to a particularly preferred embodiment substantially all of the ions 3 having different mass to charge ratios passing through the further electric field region $L_2$ may be arranged to arrive at, for example, the extraction or acceleration region 10 of an orthogonal or axial acceleration Time of Flight mass analyser at substantially the same time. Further preferably, the ions 3 may be arranged to arrive at the extraction or acceleration region 10 with substantially the same energy. Further preferably, the ions 3 may also be arranged to arrive at substantially the same relatively small region of the extraction or acceleration region 10 at substantially the same time. According to less preferred embodiments the ions 3 may be arranged to arrive at another region other than the extraction or acceleration region 10 of a Time of Flight mass analyser. For example, the ions 3 may, less preferably, be arranged to arrive at an ion trap, collision or fragmentation cell or another type of mass analyser such as a quadrupole ion trap mass analyser at substantially the same time.

The difference in velocities which is imparted to the ions 3 as they exit the further electric field region $L_2$ is preferably comparatively small and may depend upon, for example, the relative lengths of the initial field free region 8 and further field free region 9 i.e. the two time of flight regions. For example, if the further field free region 9 is relatively long compared with the initial field free region 8 then the range in ion velocities obtained by the ions 3 as they exit the further electric field region $L_2$ may be relatively small since the ions which arrive slightly later at the further electric field region $L_2$ will have a relatively longer time to catch up with the ions 3 which have already entered the further field free region 9 such that all the ions ultimately reach the extraction or acceleration region 10 of the Time of Flight mass analyser at substantially the same time.

Figure 2:
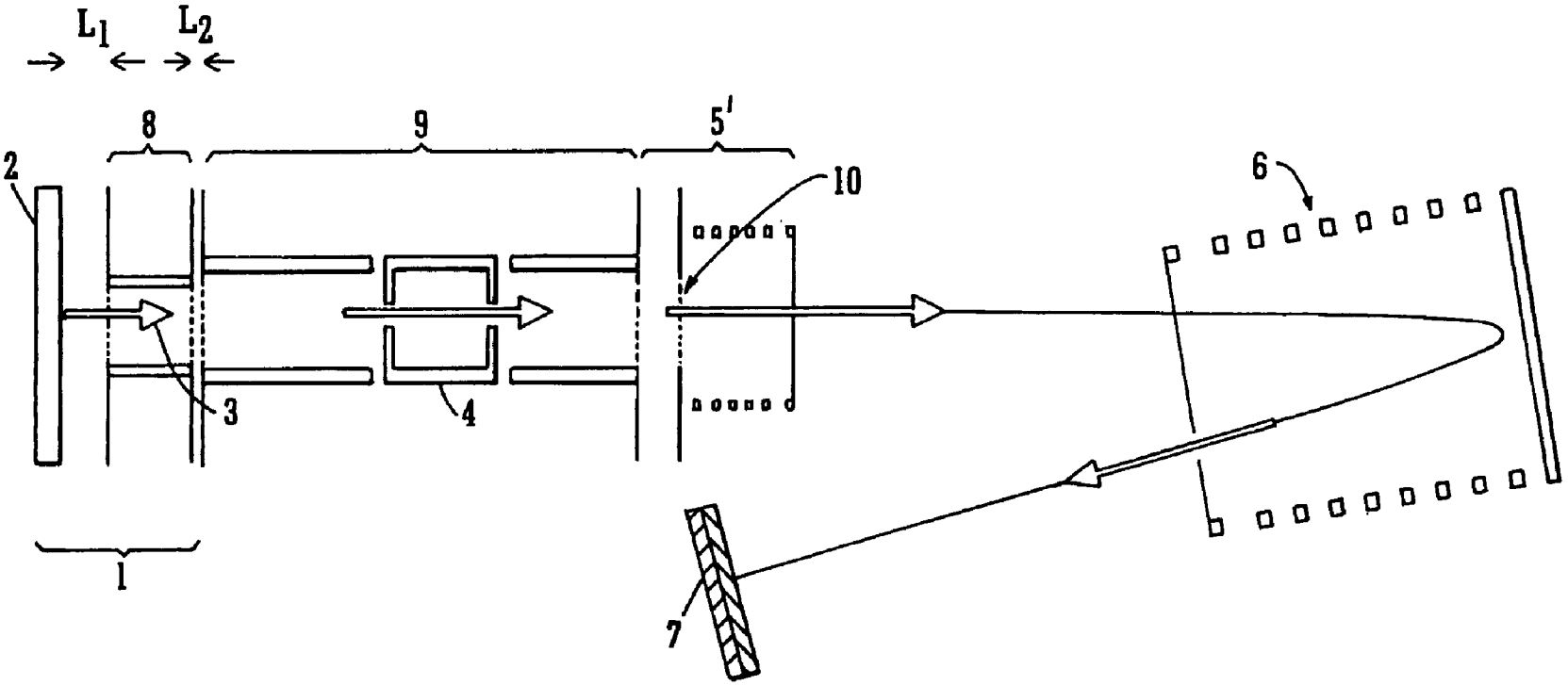
FIG. 2 shows an axial Time of Flight mass analyser according to another embodiment.

FIG. 2 illustrates how the same principle employed with an orthogonal acceleration Time of Flight mass analyser as described with reference to FIG. 1 may alternatively be employed with an axial Time of Flight mass analyser. In an axial Time of Flight mass analyser ions 3 entering the axial Time of Flight mass analyser are pulsed axially by electrodes 5' into the drift or flight region of the axial Time of Flight mass analyser.

According to either embodiment described above, a collision or fragmentation cell 4 may optionally be provided within or as part of the further field free region 9. The collision or fragmentation cell 4 may be arranged such that in a mode of operation at least some of the ions 3 passing through the further field free region 9 (i.e. second time of flight region) will be fragmented within the collision or fragmentation cell 4 into fragment (or daughter) ions. The resulting fragment ions will then preferably pass through the remaining portion of the further field free region 9 at substantially the same velocity as their corresponding parent ions 3 were travelling immediately prior to being fragmented. Similarly, fragment ions formed by Post Source Decay ("PSD"), wherein metastable parent ions spontaneously fragment into fragment ions, will also continue at substantially the same velocity as their corresponding parent ions 3 were travelling immediately prior to their spontaneous fragmentation. Accordingly, parent ions 3 and any corresponding fragment ions will preferably arrive at the extraction or acceleration region 10 of the orthogonal or axial acceleration Time of Flight mass analyser at substantially the same time. When the ions 3 arrive at the extraction or acceleration region 10, electrodes 5,5' preferably arranged adjacent the extraction or acceleration region 10 are preferably pulsed or otherwise energised in order to extract or accelerate ions 3 into the drift or flight region of the orthogonal or axial acceleration Time of Flight mass analyser.

The orthogonal or axial acceleration Time of Flight mass analyser preferably comprises an ion mirror or reflectron 6 and an ion detector 7 for detecting ions 3. The ion detector 7 preferably comprises a microchannel plate ion detector although other types of ion detector may less preferably be employed. Mass spectra are preferably recorded by the ion detector 7. In one mode of operation the mass spectra will preferably include parent ions and any corresponding fragment ions produced, for example, by Post Source Decay or by Collisionally Induced Dissociation due to fragmentation of the parent ions within a collision or fragmentation cell 4.

In order to fragment ions 3 within the collision or fragmentation cell 4 the ions 3 are preferably arranged to enter the collision or fragmentation cell 4 with sufficient energy such as to fragment upon colliding with collision gas molecules which may be provided in the collision or fragmentation cell 4.

The collision energy in the centre of mass reference frame ($E_{com}$) is:

$$E_{com} = \frac{M_t}{(M_p + M_t)} E_{lab}$$

wherein $E_{lab}$ is the kinetic energy in the laboratory frame of reference for the parent ion, $M_p$ is the mass of the parent ion and $M_t$ is the mass of the neutral target collision gas molecule.

If the parent ions have a constant velocity then the kinetic energy of each parent ion in the laboratory frame of reference $E_{lab}$ equals the mass of the parent ion $M_p$ multiplied by a constant k. Hence:

$$E_{com} = \frac{kM_t M_p}{M_p + M_t}$$

Accordingly, if the mass of the parent ion $M_p$ is much greater than the mass of the collision gas molecule $M_t$ then the collisional energy in the centre of mass frame $E_{com}$ is approximately $kM_t$ (which is approximately constant). High energy collisions may be generated using a collision gas such as xenon ($M_t$=127) and low energy collisions may be generated using a collision gas such as helium ($M_t$=4).

According to another embodiment ions 3 may be generated from a target or sample plate 2 of a Matrix Assisted Laser Desorption Ionisation ("MALDI") ion source 1 and then be accelerated to a substantially constant energy through the use of one or more constant electric fields such that the ions 3 emitted from the ion source 1 preferably have substantially the same energy (e.g. 800 eV). The energetic parent ions may then be arranged to fragment upon colliding with collision gas molecules in a collision or fragmentation cell. An ion velocity selector (e.g. a timed ion gate) may be programmed to transmit parent (and corresponding fragment) ions having a specific velocity such that they are onwardly transmitted to the extraction or acceleration region 10 of the Time of Flight mass analyser. The extraction or acceleration region 10 of the Time of Flight mass analyser may itself alternatively/additionally act as a velocity or mass to charge ratio selector i.e. mass filter.

After ions have been injected into the drift or flight region of the Time of Flight mass analyser, ions will arrive at the ion detector 7 at a time inversely proportional to their mass to charge ratio. The resulting mass spectrum may include one or more selected (or otherwise) parent ion or ions and any corresponding fragment ions created by Post Source Decay ("PSD") of the corresponding parent ions and/or by Collisionally Induced Dissociation of corresponding parent ions in the collision or fragmentation cell 4. Fragment ions created by other mechanisms may also be present.

Figure 3A:
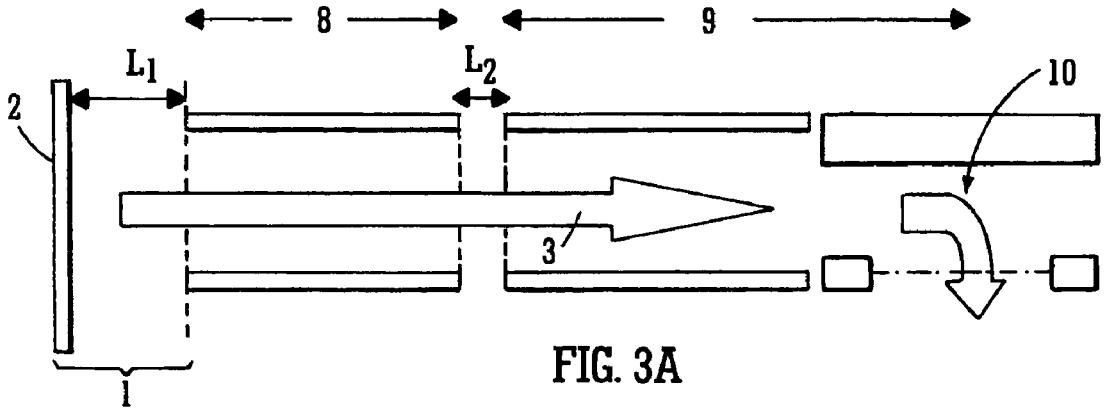
FIG. 3A shows in simplified form a portion of a preferred mass spectrometer.

FIG. 3A illustrates in simplified form the electric and field free regions according to a preferred embodiment. As discussed above, a collision or fragmentation cell 4 may be provided but is not shown in FIG. 3A for ease of illustration purposes only. Ions 3 are preferably generated at the surface of a target or sample plate 2 of an ion source 1 which is preferably a Matrix Assisted Laser Desorption Ionisation ("MALDI") ion source 1. The ions 3 are then preferably accelerated by an initial electric field which is maintained across an initial electric field region $L_1$. The electric field preferably remains substantially constant whilst ions are transmitted through the initial electric field region $L_1$. The ions 3 are preferably accelerated into an initial field free region 8 (or first time of flight region). As the ions 3 pass through the initial electric field region $L_1$ they are preferably accelerated so that they acquire substantially the same energy.

Once the ions 3 have entered the initial field free region 8 with substantially the same energy then the ions 3 will continue with velocities which are inversely proportional to the square root of their mass to charge ratio. The ions 3 will therefore preferably become temporally separated according to their mass to charge ratio within the initial field free region 8. The ions 3 then exit the initial field free region 8 and preferably enter a further electric field region $L_2$. Since the ions 3 will have become temporally separated within the initial field free region 8, ions of relatively low mass to charge ratio will exit the initial field free region 8 before ions having relatively higher mass to charge ratios.

The electric field arranged in the further electric field region $L_2$ is preferably arranged to vary with time such that the kinetic energy of the ions 3 leaving the further electric field region $L_2$ (and which subsequently enter a further field free region 9 or second time of flight region) is approximately proportional to the mass to charge ratio of those ions 3. This may be achieved by varying one or both of the potentials at which the initial 8 and further 9 field free regions are maintained. The potentials may be varied either independently or both together so that a desired time-varying electric field follows an appropriate time dependant function. For example, a sinusoidal, linear, square, cubic or stepped time dependant electric field may effectively be arranged to be provided across the further electric field region $L_2$.

If the further electric field region $L_2$ were not provided, then the ions 3 would have a transit time to the extraction or acceleration region 10 of the Time of Flight mass analyser which would be proportional to the inverse of their velocity (and hence would be approximately proportional to the square root of their mass to charge ratio). Therefore, by accelerating the ions 3 in the further electric field region $L_2$ through a potential difference which, for example, varies according to an appropriately weighted square law with time or which more preferably varies substantially sinusoidally with time as the ions 3 enter and pass through the further electric field region $L_2$, the ions 3 can be arranged to enter and pass through the further field free region 9 (i.e. second time of flight region) with slightly different velocities. Accordingly, all the ions 3 can be arranged to arrive at the extraction or acceleration region 10 of the Time of Flight mass analyser at essentially the same time.

The velocity of ions having relatively higher mass to charge ratios may according to an embodiment be slightly increased relative to the velocity of ions having relatively lower mass to charge ratios. Arranging for the ions 3 to have slightly different velocities as they pass through the further field free region 9 ensures that ions having relatively higher mass to charge ratios will begin to catch up with ions having relatively lower mass to charge ratios which have already entered the further field free region 9. This may be achieved, for example, by increasing the power of the time dependent electric field $E_2$ applied across the further electric field region $L_2$ with time. It is also contemplated that the time varying electric field $E_2$ may less preferably comprise a pulsed electric field and the frequency of the pulses may be increased with time.

Advantageously, ions 3 having different mass to charge ratios and/or different velocities upon entering the further electric field region $L_2$ may nonetheless be arranged to arrive substantially simultaneously at the same portion of an extraction or acceleration region 10 of a Time of Flight mass analyser with the result that a significant improvement in duty cycle can be obtained in a MS mode of operation. Indeed, a duty of cycle of substantially 100% is achievable according to the preferred embodiment in a MS mode of operation.

Figure 3B:
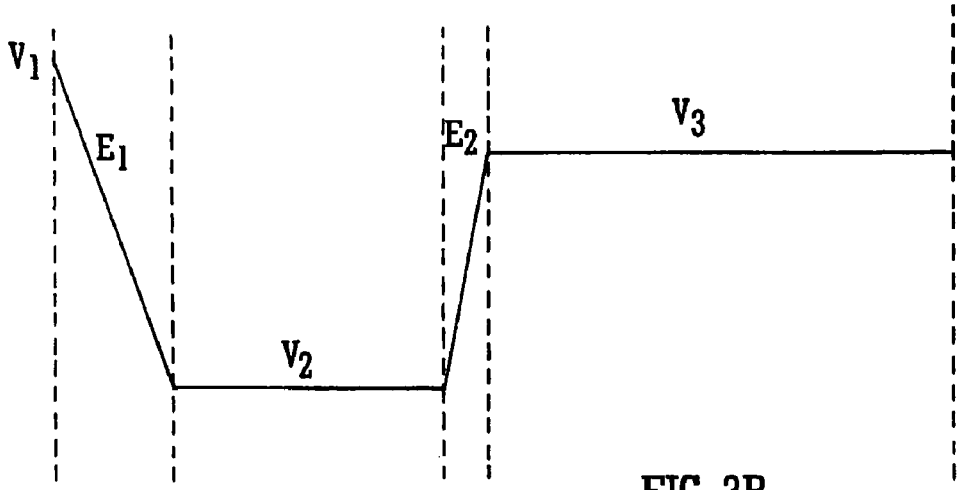
FIG. 3B illustrates the preferred electric potential profile along the portion of the mass spectrometer at one instant in time and FIG. 3C illustrates an exponential time-varying electric field applied to the time varying electric field region according to an embodiment.

FIG. 3B shows the electric potentials $V_1$,$V_2$,$V_3$ at which the target or sample plate 2, the initial field free region 8 and the further field free region 9 respectively may be maintained at one instant in time according to an embodiment. The electric potentials $V_1$,$V_2$,$V_3$ are preferably applied such that the electric field $E_1$ applied across the initial electric field region $L_1$ remains substantially constant with time, preferably at least until substantially all of the ions 3 have passed into the initial field free region 8. In contrast, the electric field $E_2$ applied across the further electric field region $L_2$ preferably varies with time whilst ions pass through the further electric field region $L_2$. The electric field strength $E_1$ of the electric field in the initial electric field region $L_1$ having a length $d_1$ is given by:

$$E_1 = \frac{(V_1 - V_2)}{d_1}$$

wherein $V_1$ is the potential of the target or sample plate 2 and $V_2$ is the potential at which the initial field free region 8 is maintained.

The electric field strength $E_2$ in the further electric field region $L_2$ having a length $d_2$ is given by:

$$E_2 = \frac{(V_2 - V_3)}{d_2}$$

wherein $V_3$ is the potential at which the further field free region 9 is maintained.

The further electric field $E_2$ is preferably varied with time by either varying the potential $V_3$ at which the further field free region 9 is maintained with time and maintaining the potential $V_1$ and/or potential $V_2$ constant, or by varying the potential $V_1$ and/or potential $V_2$ with time and maintaining the potential $V_3$ constant. Alternatively, in a less preferred embodiment the potential $V_1$ and/or the potential $V_2$ and/or the potential $V_3$ may be varied with time to produce electric fields $E_1$ and $E_2$ which both vary with time. If the electric field $E_1$ does vary with time then preferably the electric field $E_1$ only significantly varies in electric field strength once ions have exited the initial electric field region $L_1$.

According to a preferred embodiment ions 3 may be caused to arrive at the extraction or acceleration region 10 of a Time of Flight mass analyser at substantially the same time by employing a time dependent potential $V_2$ and/or potential $V_3$ which has, for example, a cubic time dependency or which more preferably which varies sinusoidally with time. For example, in one embodiment the initial electric field region $L_1$ may have a length $d_1$ of 3 mm and a constant electric field $E_1$ may be arranged across the initial electric field region $L_1$ by maintaining the potential VI and the potential $V_2$ at 0 V and −800 V (DC) respectively. The initial field free region 8 may have a length of 50 mm. The further electric field region $L_2$ may have a length $d_2$ of 3 mm and the further field free region 9 may have a length of 97 mm. The further field free region 9 may, according to an embodiment, be maintained at a potential $V_3$ which is varied with time such that $V_3=-1.25t^3-20$, where t is time in μs. Hence, the electric field strength of the electric field $E_2$ maintained across the further electric field region $L_2$ may be given by:

$$E_2 = \frac{1.25t^3 - 780}{d_2}$$

In the further field free region 9 the ions 3 will have a kinetic energy of $q(V_1-V_3)$ electron-volts, where q is the ion charge in coulombs. In the above example ions having relatively low mass to charge ratios which arrive at the further electric field region $L_2$ before other ions may be effectively retarded by the time-varying electric field $E_2$ whilst other ions having relatively higher mass to charge ratios which arrive later at the further electric field region $L_2$ may be effectively accelerated by the time-varying electric field $E_2$. The direction of the electric field $E_2$ may therefore change whilst ions are passing through the further electric field region $L_2$ i.e. the fastest ions may be retarded and the slowest ions may be accelerated.

Figure 3C:
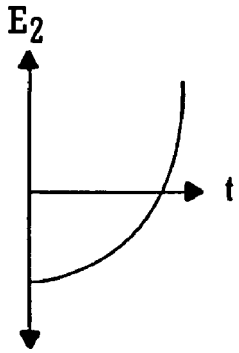

FIG. 3C shows an example of a time-varying electric field $E_2$ which may be applied across the further electric field region $L_2$. In this embodiment the electric field strength of the electric field $E_2$ applied across the further electric field region $L_2$ rises substantially exponentially or approximately exponentially with time. The electric field $E_2$ may, for example, be varied with time such that the ions which enter the further electric field region $L_2$ before other ions may be decelerated whereas ions which arrive in the further electric field region $L_2$ at a later time may be accelerated or relatively less severely decelerated. Accordingly, preferably at least some ions 3 having preferably widely differing mass to charge ratios will arrive at the extraction or acceleration region 10 of the Time of Flight mass analyser at substantially the same time.

Figure 4A:
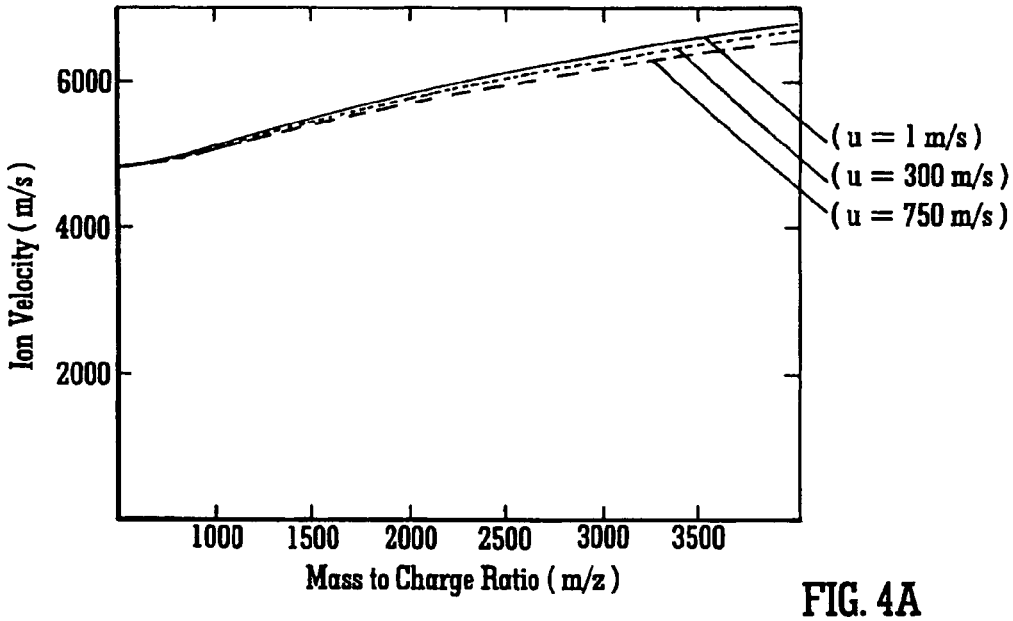
FIG. 4A shows the resulting velocity of singly charged ions as a function of mass to charge ratio for ions having different initial velocities which were accelerated by both a constant electric field and a time-varying electric field according to an embodiment of the present invention.

FIG. 4A shows the calculated velocity of three groups of singly charged ions as a function of mass to charge ratio for ions having initial ion velocities of 1, 300 and 750 m/s and having been accelerated by a time-varying electric field according to the preferred embodiment. The ions have firstly been accelerated by a constant electric field $E_1$ arranged in an initial electric field region $L_1$ immediately adjacent the target or sample plate 2 of the ion source 1. The ions have then been further accelerated by a time-varying electric field $E_2$ arranged in a further electric field region $L_2$ downstream of the constant electric field $E_1$.

Figure 4B:
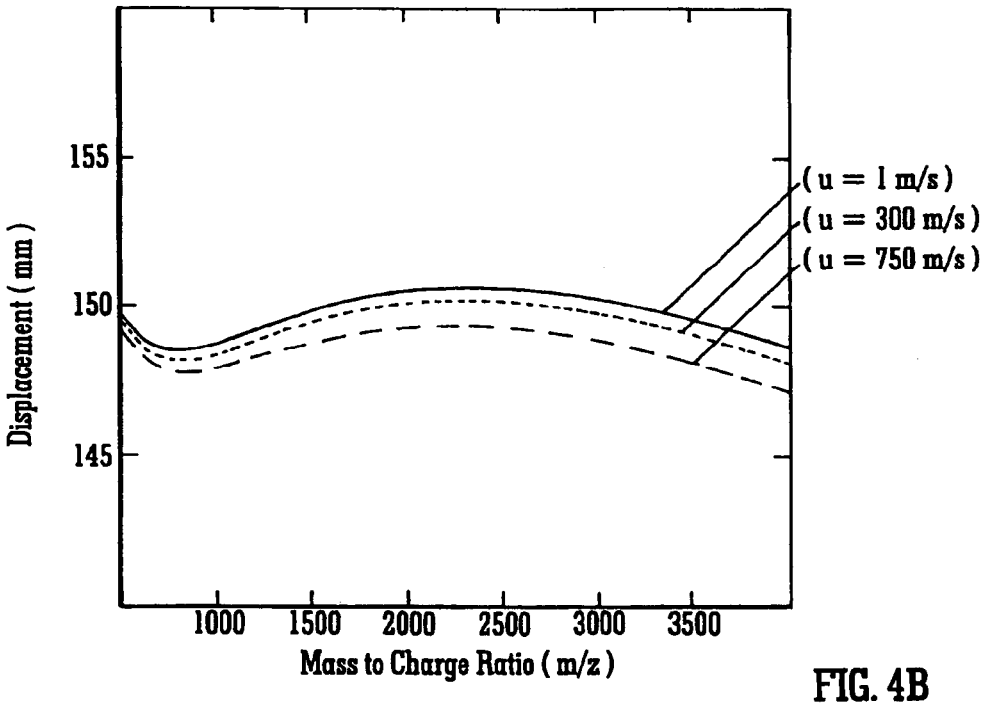
FIG. 4B shows the resulting dispersion of the ions.

FIG. 4B shows the displacement or dispersement of these ions at the time when ions having a mass to charge ratio of 2000 and an initial velocity of 300 m/s arrive at the centre of the extraction or acceleration region 10 of the orthogonal acceleration Time of Flight mass analyser. As can be seen from FIG. 4B, the difference in displacement (i.e. spatial separation) of the ions 3 at the time that ions having a mass to charge ratio of 2000 and an initial velocity of 300 m/s reach the centre of the extraction or acceleration region 10 is advantageously only approximately 3.5 mm across a relatively wide range of mass to charge ratios and for ions having widely differing initial ion velocities. Such a small spatial separation or dispersion is significantly smaller than the spatial separation or dispersion which would otherwise be observed if the ions were accelerated to a constant energy and were then passed directly to an extraction or acceleration region in a conventional manner, i.e. without passing the ions through a time-varying electric field region $L_2$ according to the preferred embodiment.

Although a cubic time dependent electric field has been described according to an embodiment, further or different time-varying functions may be employed by varying the potentials $V_1,V_2,V_3$ as desired. For example, one or more different or more complex time-varying voltages may be applied to components of the mass spectrometer. For example, the time varying electric field $E_2$ may be provided by one or more voltages having, for example, an exponential ramp function $V(t)=a.\ [\exp\hat{}\ ((t-t_0)/b)-c]$, a linear ramp function $V(t)=a.\ (t-t_0)+b$, a square law ramp function $V(t)=a.\ [(t-t_0)^2]+b$, a cubic law ramp function $V(t)=a.\ (t-t_0)^3+b$, a power law ramp function $V(t)=a.\ (t-t_0)^b$, a sinusoidal function $V(t)=a+b.\cos[c(t-t_0)+d]$, a quadratic or higher order polynomial function $V(t)=a+b(t-t_0)+c\ (t-t_0)^2+d\ (t-t^0)^3$ or multiple stepped functions, wherein a,b,c,d and $t_o$ are constants. The potential functions preferably vary with time such that they provide an accelerating field and/or decelerating field for ions passing through the electric field region $L_2$. The electric fields may also comprise either homogeneous or heterogeneous electric fields $E_1,E_2$ or a combination of both.

Figure 5A:
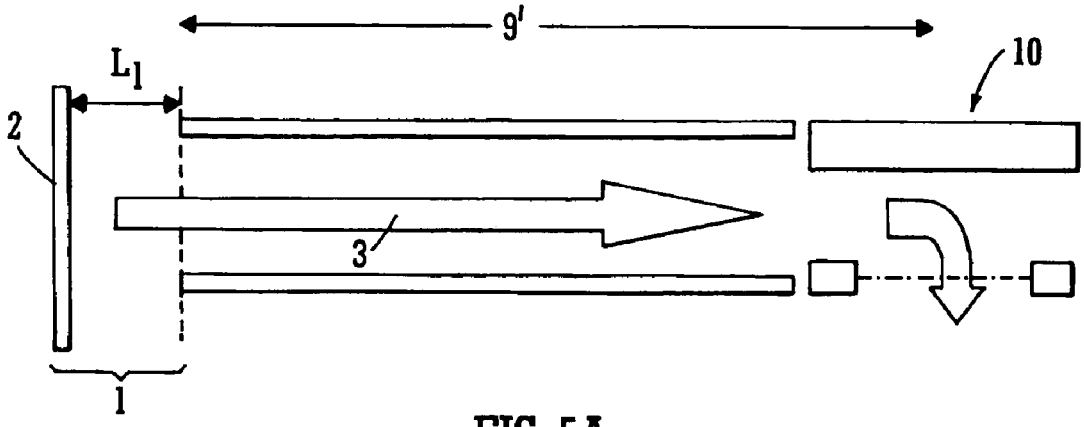
FIG. 5A shows in simplified form a portion of a less preferred embodiment comprising a time-varying electric field region arranged immediately adjacent the ion source and FIG. 5B illustrates the electric potential profile which may be arranged along the time varying electric field region and a subsequent field free region at one instant in time.
Figure 5B:
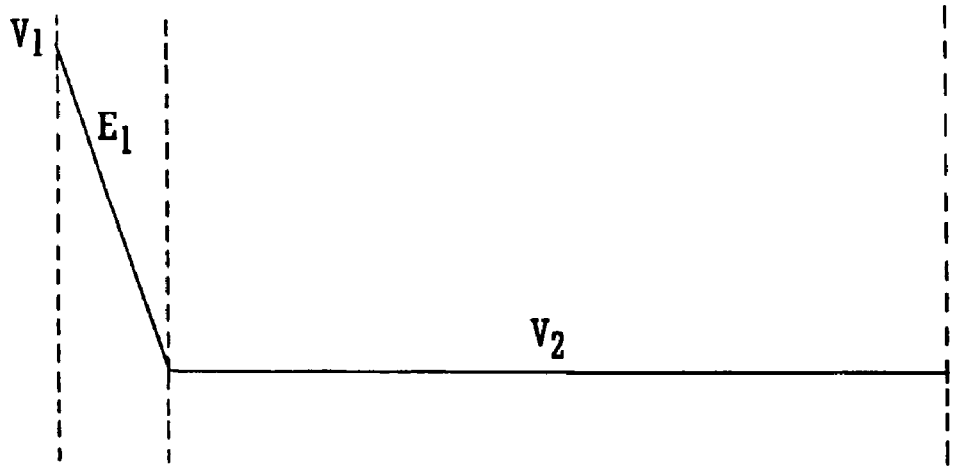

FIG. 5A illustrates a less preferred embodiment wherein ions 3 pass from a target or sample plate 2 of an ion source 1 to the extraction or acceleration region 10 via a single electric field region $L_1$. A time-varying electric field $E_1$ is preferably arranged to be provided in the electric field region $L_1$. Ions 3 are generated at the target or sample plate 2 of the ion source 1 which is preferably a Matrix Assisted Laser Desorption Ionisation ("MALDI") ion source. The electric field region $L_1$ is preferably arranged immediately adjacent to and preferably downstream of the target or sample plate 2. The electric field $E_1$ arranged in the electric field region $L_1$ preferably accelerates and/or decelerates at least some of the ions 3 generated at the target or sample plate 2 and the ions 3 then preferably pass into a field free region 9'. The field free region 9' preferably continues to the extraction or acceleration region 10 of the Time of Flight mass analyser. FIG. 5B illustrates an example of the electric potential profile which may be provided in the portion of the Time of Flight mass analyser from the target or sample plate 2 to the centre of the extraction or acceleration region 10 at a point in time. The potential $V_1$ at which of the target or sample plate 2 is maintained and/or the potential $V_2$ at which the field free region 9' is maintained may be varied with time in order to produce a time-varying electric field $E_1$ which is then experienced by ions emitted from the sample or target plate 2.

Although in the above embodiments a time varying electric field $E_1,E_2$ may be generated by varying the potential $V_1,V_2,V_3$ applied to the field free region(s) (i.e. time of flight region(s)) and/or the target or sample plate 2, according to other embodiments it is contemplated that one or more electrodes may be arranged in the electric field region(s) $L_1,L_2$ in order to produce the desired electric field $E_1,E_2$.

In a preferred embodiment the time-varying electric field $E_1$ which accelerates and/or decelerates ions 3 varies either substantially exponentially or substantially sinusoidally in time. This may be achieved by maintaining a potential difference across the electric field region $L_1$ which varies exponentially or sinusoidally with time. An example of such an embodiment is described below.

An exponential or sinusoidal electric field may be provided, for example, in the further electric field region $L_2$ of the embodiment shown and described in relation to FIGS. 1, 2 and 3A or in the single electric field region $L_1$ of the embodiment shown and described in relation to FIG. 5A. The following example of an exponential electric field is described with reference to the single electric field region $L_1$ shown in FIG. 5A. The potential difference across the time-varying electric field region $L_1$ is given by:

$$V_1 - V_2 = V_0\left(\exp\left(\frac{t}{t_c}\right) - 1\right)$$

where $V_0$ is a constant and $t_c$ is a time constant.

Therefore, the linear electric field $E_1$ that is present across the length of the electric field region $L_1$ at a time t is given by:

$$E_1 = \frac{V_0}{d_1}\left(\exp\left(\frac{t}{t_c}\right) - 1\right)$$

The acceleration (acc) of an ion of given mass to charge ratio m/z at a time t in the time-varying electric field $E_1$ is approximated as follows (after approximating to a slightly non-zero starting electric field):

$$acc = \frac{q}{m} \cdot \frac{V_0}{d_1}\exp\left(\frac{t}{t_c}\right)$$

where q is the charge on the ion.

Integrating the acceleration with respect to time gives the velocity (vel) of an ion at time t:

$$vel = \frac{q}{m} \cdot \frac{V_0 t_c}{d_1}\exp\left(\frac{t}{t_c}\right) + C_1$$

where $C_1$ is a constant.

Integrating the velocity with respect to time gives the displacement x of the ion at time t:

$$x = \frac{q}{m} \cdot \frac{V_0 t_c^2}{d_1}\exp\left(\frac{t}{t_c}\right) + C_1 \cdot t + C_2$$

where $C_2$ is another constant.

If it is assumed that the initial axial ion velocity and the initial ion displacement x are zero, then the constants of integration $C_1$ and $C_2$ are negligible. Therefore, solving for the time of flight $t_1$ over the length $d_1$ of the electric field region $L_1$ gives:

$$t_1 = \ln\left(\frac{m}{q} \cdot \frac{d_1^2}{V_0 t_c^2}\right) \cdot t_c$$

Substitution of the time of flight $t_1$ into the above equation for the velocity of an ion gives the velocity (vel_ffr) of an ion within the field free region 9' arranged between the time varying electric field region $L_1$ and the centre of the extraction region 10. The velocity vel_ffr of an ion in the field free region 9' is independent of the mass to charge ratio and is given by:

$$\text{vel_ffr} = \frac{L_1}{t_c}$$

Hence, under these approximations the velocity vel_ffr of an ion in the field free region 9' is independent of the mass to charge ratio of the ion. Therefore all ions 3, irrespective of their mass to charge ratio, will have the same time of flight from the exit of the time-varying electric field region $L_1$ to the extraction or acceleration region 10. Accordingly, all the ions 3 will arrive at the extraction or acceleration region 10 at substantially the same time.

Figure 6A:
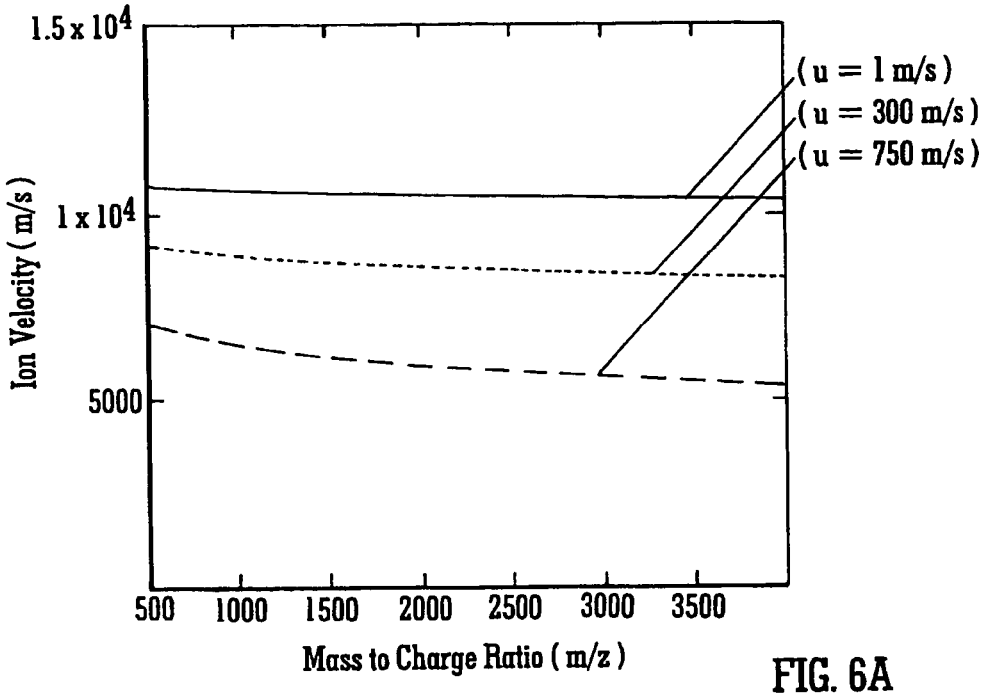
FIG. 6A shows the resulting velocity of singly charged ions as a function of mass to charge ratio for ions having different initial velocities which were accelerated only by a time-varying electric field according to a less preferred embodiment.
Figure 6B:
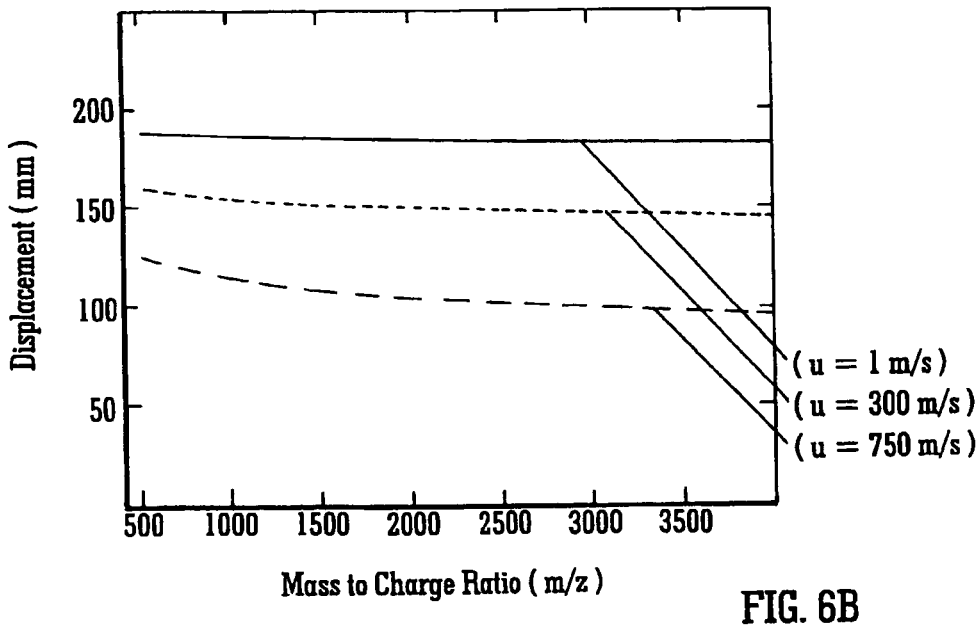
FIG. 6B shows the resulting dispersement of the ions.

However, according to a more detailed mathematical analysis allowing for initial ion velocities and a zero starting electric field, all of the ions 3 do not necessarily have the same time of flight from the exit of the time-varying electric field region $L_1$ to the extraction or acceleration region 10 but may have considerable differences in velocity and energy, as shown in FIGS. 6A and 6B and as will be described in more detail below. Despite this, the spatial separation or dispersion of the ions 3 at the extraction or acceleration region 10 of the Time of Flight mass analyser will still be significantly smaller than the spatial separation or dispersion inherent with a conventional mass analyser wherein ions are simply accelerated from the ion source to the extraction or acceleration region 10 using just a constant electric field.

FIG. 6A shows the calculated velocity of three groups of singly charged ions as a function of mass to charge ratio for ions having initial ion velocities of 1, 300 and 750 m/s and having been accelerated just by a time-varying electric field according to a less preferred embodiment. In this simulation the length $d_1$ of the time-varying electric field region $L_1$ was 3 mm, the length of the single field free region 9' (or single time of flight region) was 150 mm and the time constant $t_c$ was 0.29 μs. Accordingly, the potential difference across the electric field region $L_1$ was $V_1-V_2=\exp(t/0.29)-1$, where t is the time in μs.

FIG. 6B shows the displacement or dispersement of these ions 3 at the time when ions having a mass to charge ratio of 2000 and an initial velocity of 300 m/s arrive at the centre of the extraction or acceleration region 10 of the orthogonal acceleration Time of Flight mass analyser. As can be seen from FIG. 6B, the difference in displacement (i.e. spatial separation) of the ions 3 at the time that ions having a mass to charge ratio of 2000 and an initial velocity of 300 m/s reach the centre of the extraction or acceleration region 10 is approximately 93 mm across a relatively wide range of mass to charge ratios and widely differing initial ion velocities. The spatial separation or dispersant of the ions 3 at the extraction or acceleration region 10 of the Time of Flight mass analyser in this less preferred embodiment is larger than that of the preferred embodiment. However, the separation or dispersement is still significantly smaller (e.g. about half) than the spatial separation or dispersement observed using a conventional mass analyser wherein the ion source accelerates ions to the extraction region or acceleration region using only a constant electric field.

Figure 7A:
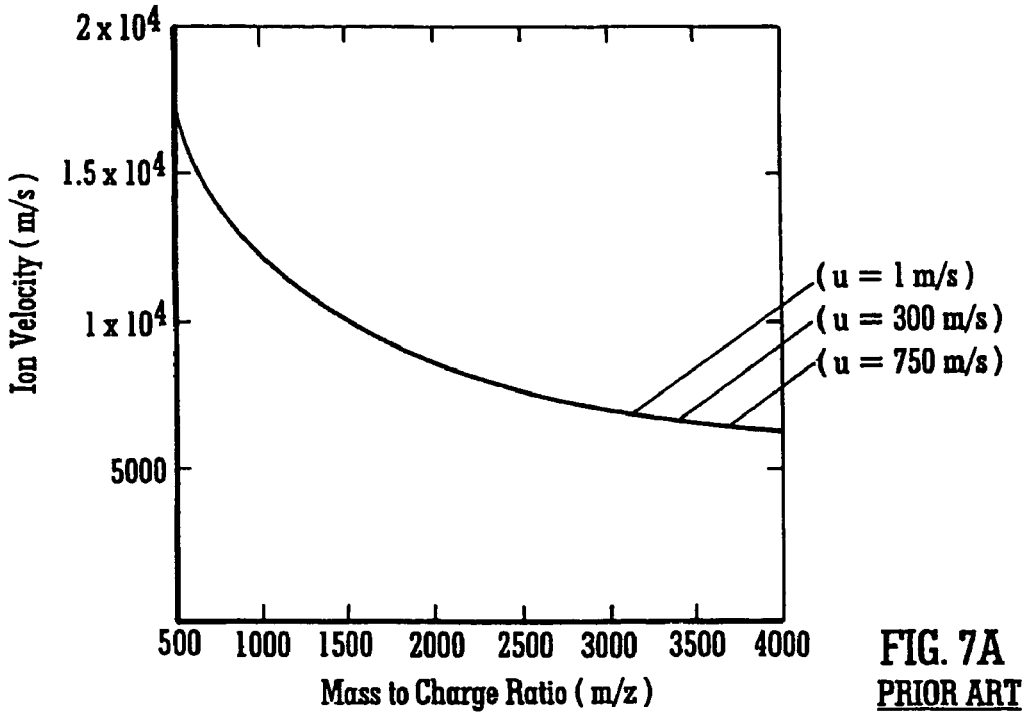
FIG. 7A PRIOR ART
FIG. 7A shows the velocity of singly charged ions as a function of mass to charge ratio for ions having different initial velocities and having been accelerated to a constant energy in a conventional manner and FIG. 7B shows the resulting dispersement of the ions.

FIG. 7A shows the calculated velocity of three groups of singly charged ions as a function of mass to charge ratio for ions having initial ion velocities of 1, 300 and 750 m/s. The ions have been accelerated in accordance with conventional techniques by only using a constant electric field. A potential difference of 800 V was simulated between the target or sample plate of the ion source and the field free region in order to simulate the acceleration of the ions to a constant energy of 800 eV. Accordingly, the velocities of the ions will be inversely proportional to the square root of their mass to charge ratios.

Figure 7B:
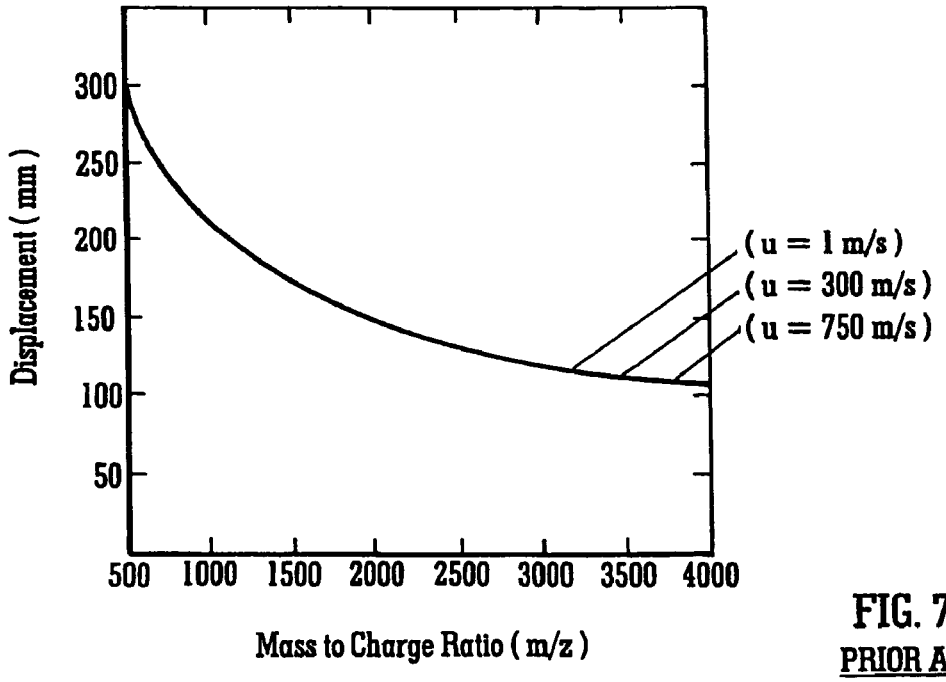
FIG. 7B PRIOR ART

FIG. 7B shows the displacement of these ions at the time when ions having a mass to charge ratio of 2000 and an initial velocity of 300 m/s arrive at the centre of the extraction or acceleration region of the orthogonal acceleration Time of Flight mass analyser. As can be determined from FIG. 7B, the difference in displacement (i.e. spatial separation) of the ions at the time that ions having a mass to charge ratio of 2000 and an initial velocity of 300 m/s reach the centre of the extraction or acceleration region is approximately 194 mm across a relatively wide range of mass to charge ratios and widely differing initial ion velocities. This is a much larger spatial separation than the corresponding spatial separation or dispersement achieved by accelerating ions according to the preferred embodiment of the present invention wherein the spatial separation was only a few millimeters or less. Therefore, it will be appreciated that with a conventional mass analyser the duty cycle in a MS mode of operation will be relatively poor.

Figure 8:
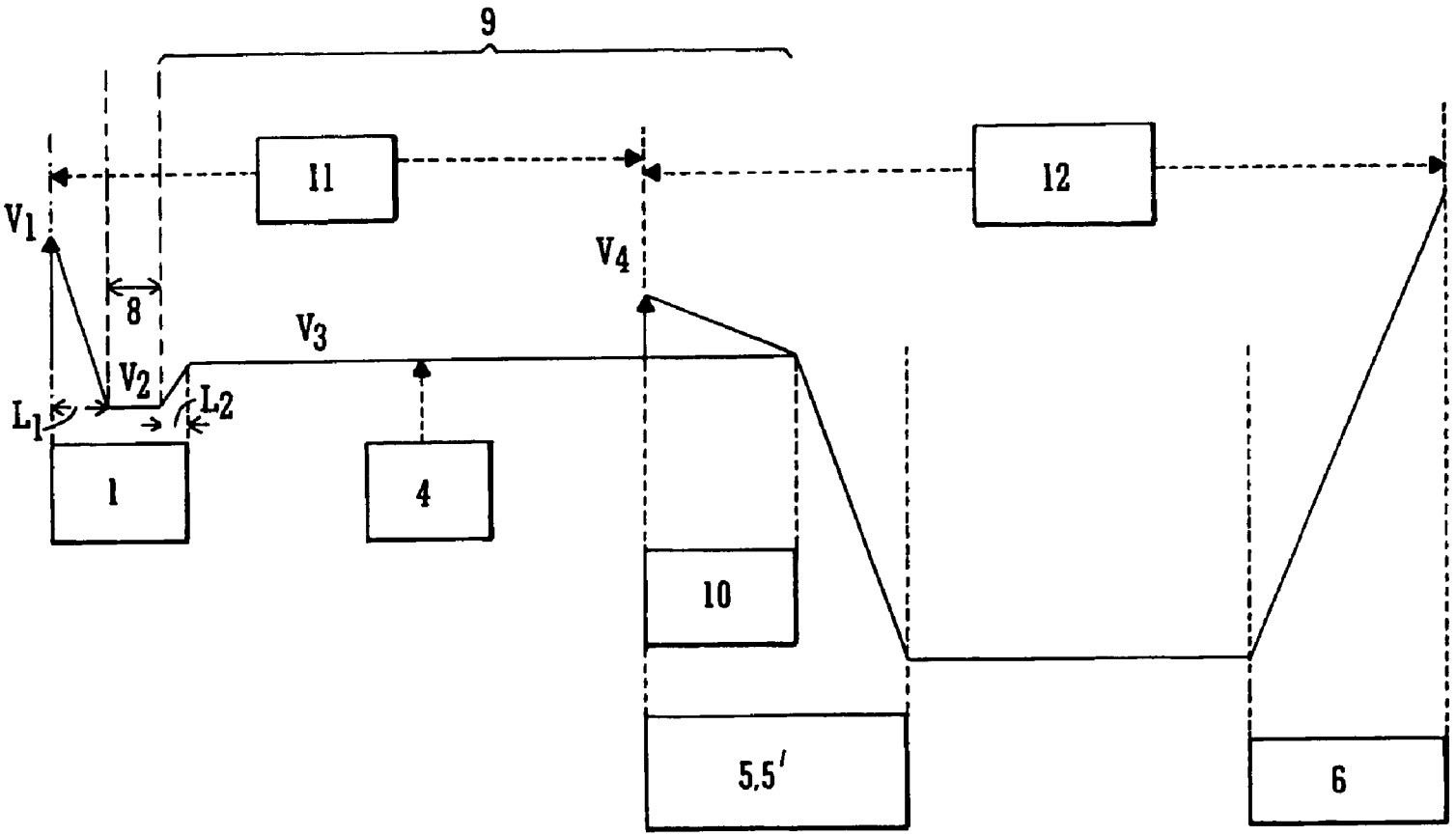
FIG. 8 shows the electric potential profile along a preferred mass spectrometer at one instant in time.

FIG. 8 shows an example of the electric potential profile across a mass spectrometer according to the preferred embodiment at one instant in time. The mass spectrometer may be considered to comprise a first section 11 (comprising an ion source 1 and an acceleration means) and a second section 12 (comprising an orthogonal acceleration Time of Flight mass analyser 12 having a reflectron 6). The ion source 1 preferably comprises a Matrix Assisted Laser Desorption Ionisation ("MALDI") ion source 1 and generates ions 3 at a target plate 2 which may be maintained at a first potential $V_1$. The ions 3 may pass from the target or sample plate 2 through an initial electric field region $L_1$ and preferably to an initial field free region 8 downstream of the target or sample plate 2. The initial field free region 8 is preferably formed of at least one electrode which may be maintained at a second potential $V_2$. The ions 3 may then exit the initial field free region 8 (or first time of flight region) and pass through a further electric field region $L_2$ and then preferably into a further field free region 9 (or second time of flight region). The further field free region 9 is preferably upstream of the pulsed extraction or acceleration region 10 of a orthogonal acceleration Time of Flight mass analyser 12. The further field free region 9 may be formed by one or more electrodes which are preferably maintained at a third potential $V_3$. The further field free region 9 may include a collision or fragmentation cell 4. The potentials $V_1$,$V_2$,$V_3$ may be different and may be varied with time such that the electric field in the initial electric field region $L_1$ and/or the electric field in the further electric field region $L_2$ are as desired. The ions 3 pass through the further field free region 9 and then pass into the pulsed extraction or acceleration region 10 of the Time of Flight mass analyser 12 wherein a pulsed extraction potential $V_4$ causes the ions 3 to be accelerated through an acceleration or flight region of the Time of Flight mass analyser. The ions 3 are preferably accelerated towards an ion mirror or reflectron 6 which reflects the ions 3 back towards an ion detector 7.

The ion source 1 preferably produces ions 3 of approximately constant velocity and therefore the kinetic energy of the ions 3 emitted from the ion source 1 is preferably proportional to their mass to charge ratio. In an embodiment a specific range of parent ions having a specific range of kinetic energies may be selected and transmitted using an electrostatic ion energy analyser, mass filter or ion gate (not shown) arranged preferably upstream of a collision or fragmentation cell 4. The energy analyser or mass filter may be configured to reject low mass to charge ratio (and hence low energy) ions without the need for the complexity of a high speed matrix suppression lens. Additionally/alternatively, an ion gate may be arranged downstream of a collision or fragmentation cell 4.

Figure 9A:
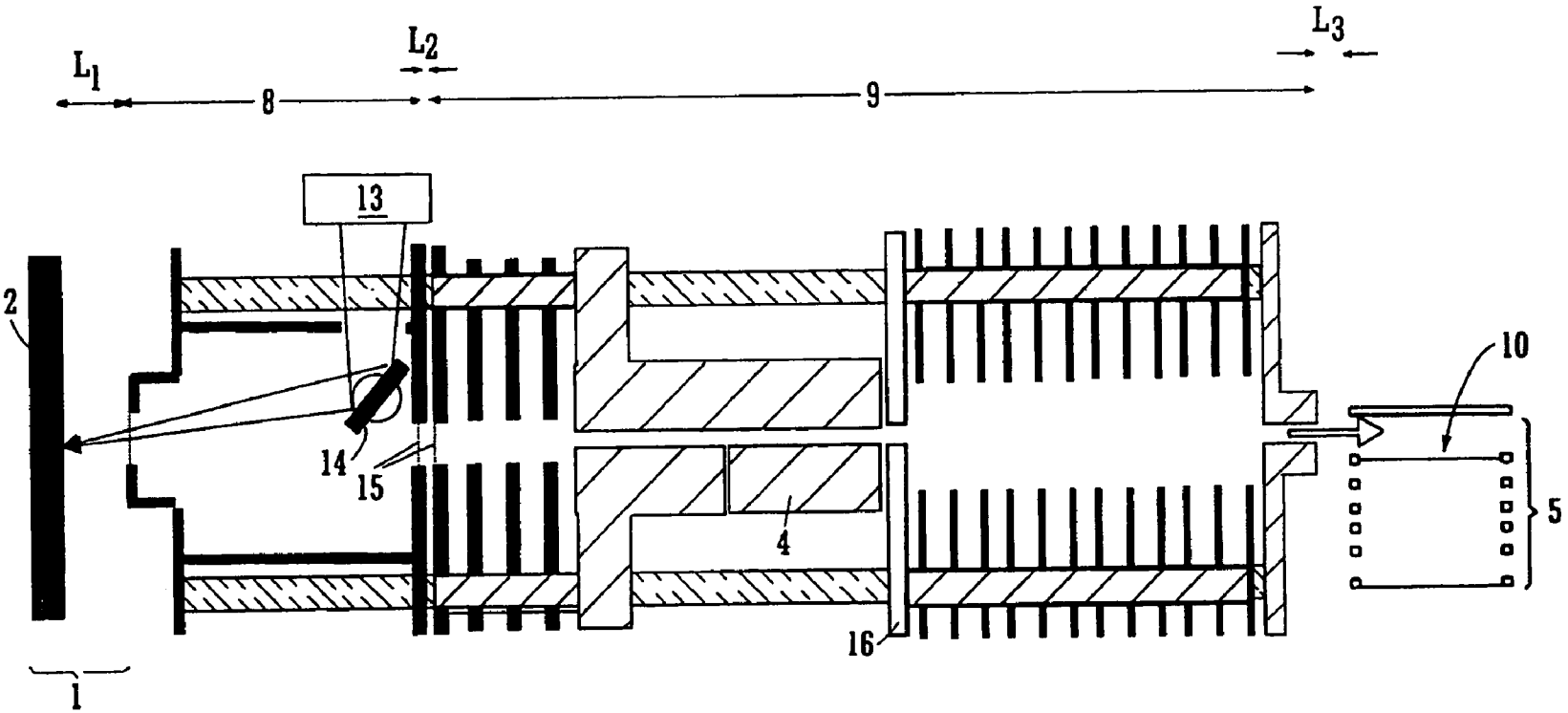
FIG. 9A shows a schematic of a portion of a particularly preferred mass spectrometer.

FIG. 9A shows a schematic of the electric and field free regions according to a particularly preferred embodiment. Ions 3 are preferably generated at the surface of a sample or target plate 2 of an ion source 1, which is preferably a Matrix Assisted Laser Desorption Ionisation ("MALDI") ion source or a Desorption/Ionisation on Silicon ("DIOS") ion source. The ions 3 may be generated at the surface of a target or sample plate 2 in the ion source 1 by illuminating the surface of the target or sample plate 2 with a laser pulse or beam from a laser source 13. Preferably, a mirror 14 is provided to reflect the laser pulse or beam onto the surface of the target or sample plate 2 in order to generate the ions 3. In a preferred embodiment the mirror 14 may be adjustable such that the angle at which the laser pulse or beam is reflected can be altered. In a preferred embodiment the mirror 14 is provided in the initial field free region 8 but displaced from the path along which ions 3 will be transmitted in use.

The ions 3 which are generated at the target or sample plate 2 are then preferably accelerated by an electric field which is maintained across an initial electric field region $L_1$. The electric field preferably remains substantially constant whilst ions 3 are transmitted through the initial electric field region $L_1$. The ions 3 are preferably accelerated into an initial field free region 8. In a preferred embodiment the initial field free region is preferably arranged approximately 8 mm downstream of the target or sample plate 2, although the separation between the initial field free region 8 and the target or sample plate 2 may vary according to other embodiments. As the ions 3 pass through the initial electric field region $L_1$ the ions 3 are preferably accelerated such that they acquire substantially the same energy. The initial field free region 8 is preferably approximately 45 mm in length although the initial field free region 8 may have different lengths according to other embodiments. In a particularly preferred embodiment the initial field free region 8 comprises or is formed by (or within) a substantially cylindrical or tubular electrode which preferably has a window portion to enable a laser pulse or beam from the laser source 13 to pass to the mirror 14.

After the ions 3 have entered the initial field free region 8 with substantially the same energy the ions 3 will continue through the initial field free region 8 with velocities which are inversely proportional to the square root of their mass to charge ratio. The ions 3 will therefore become temporally separated according to their mass to charge ratio within the initial field free region 8 i.e. the initial field free region acts as a time of flight or drift region. The ions 3 then preferably enter a further electric field region $L_2$. Since the ions 3 will have become temporally separated within the initial field free region 8, ions of different mass to charge ratios will enter the further electric field region $L_2$ at substantially different times. The electric field arranged in the further electric field region $L_2$ is preferably arranged to vary with time such that ions having different mass to charge ratios and which arrive in the further electric field region $L_2$ at different times will be decelerated (or less preferably accelerated) at different rates. As such, ions 3 having different mass to charge ratios may be decelerated (or accelerated) in the further electric field region $L_2$ such that the ions 3 then enter a further field free region 9 having substantially the same velococity or more preferably having slightly different velocities such that the ions 3 ultimately arrive at the extraction or acceleration region 10 at substantially the same time. The further field free region 9 therefore acts as a second time of flight or drift region. In a preferred embodiment the length of the further electric field region $L_2$ is approximately 5 mm although this length may vary according to other embodiments.

In the preferred embodiment the further field free region 9 may comprise one or more stack of electrodes, for example ring electrodes, and/or one or more cylindrical or tubular electrodes. In a preferred embodiment the further field free region 9 has a length of approximately 150 mm, although this length may vary according to other embodiments.

The further field free region 9 preferably comprises or includes a collision or fragmentation cell 4. The collision or fragmentation cell 4 preferably comprises a capillary or channel having a relatively narrow bore for receiving a gas and wherein in use ions 3 preferably pass through the capillary or channel. The capillary or channel may have a square, circular; rectangular or other shaped cross-section. According to a preferred embodiment the capillary or channel of the collision or fragmentation cell 4 has a 1 mm×12.5 mm rectangular cross-section and a length of approximately 50 mm, although these dimensions may vary according to other embodiments. Preferably, no RF or AC electric fields are provided within or to the collision or fragmentation cell 4 i.e. ions are not radially confined. In the preferred embodiment, the collision or fragmentation cell 4 may be arranged within the further field free region 9 and is preferably spaced from the upstream and/or downstream end or region of the further field free region 9. Insulating material, for example ceramic material, may be provided radially outward of the collision or fragmentation cell 4. In a preferred embodiment, the portions of the further field free region 9 upstream and downstream of the collision or fragmentation cell 4 may be spaced apart by the insulating material. In a preferred embodiment an ion gate 16 or other form of mass filter may be provided upstream and/or downstream of the collision or fragmentation cell 4. In a MS/MS mode of operation an ion gate may be used to select and transmit parent (and fragment) ions having a specific velocity such that they are onwardly transmitted to (or from) the collision or fragmentation cell 4 and onwards to the extraction or acceleration region 10 of the Time of Flight mass analyser. The ion gate 16 may comprise two half plate electrodes.

In a preferred embodiment one or more grid electrodes 15 may be provided between the initial field free region 8 and the further field free region 9 and/or to define the further electric field region $L_2$. The one or more grid electrodes 15 preferably have a high transmission, e.g. at least a 90% transmission and are preferably substantially parallel to each other if two or more grid electrodes 15 are provided. The grid electrodes 15 preferably maintain the electric field in the further electric field region $L_2$ substantially parallel to the axis of the initial 8 and further 9 field free regions.

In a particularly preferred embodiment an acceleration region $L_3$ is provided between the further field free region 9 and the extraction or acceleration region 10. In use the further field free region 9 is preferably maintained at a potential which is more positive than that of the extraction or acceleration region 10 before the extraction or acceleration region 10 is pulsed. The potential difference across the acceleration region $L_3$ is preferably maintained constant until at least some of the ions having different mass to charge ratios have passed into the extraction or acceleration region 10. The ions 3 are preferably accelerated from the further field free region 9 into the extraction or acceleration region 10 as they pass through the acceleration region $L_3$. The ions 3 may therefore be accelerated in the acceleration region $L_3$ such that they arrive at the extraction or acceleration region 10 of the Time of Flight mass analyser at substantially the same time and having substantially the same energy. Advantageously, by accelerating the ions 3 through the acceleration region $L_3$ the length of the detector plates in an orthogonal acceleration Time of Flight mass analyser may be reduced. The acceleration region $L_3$ is preferably relatively short and may have a length, for example, of 10 mm although according to other embodiments the length of the acceleration region $L_3$ may be different.

Figure 9B:
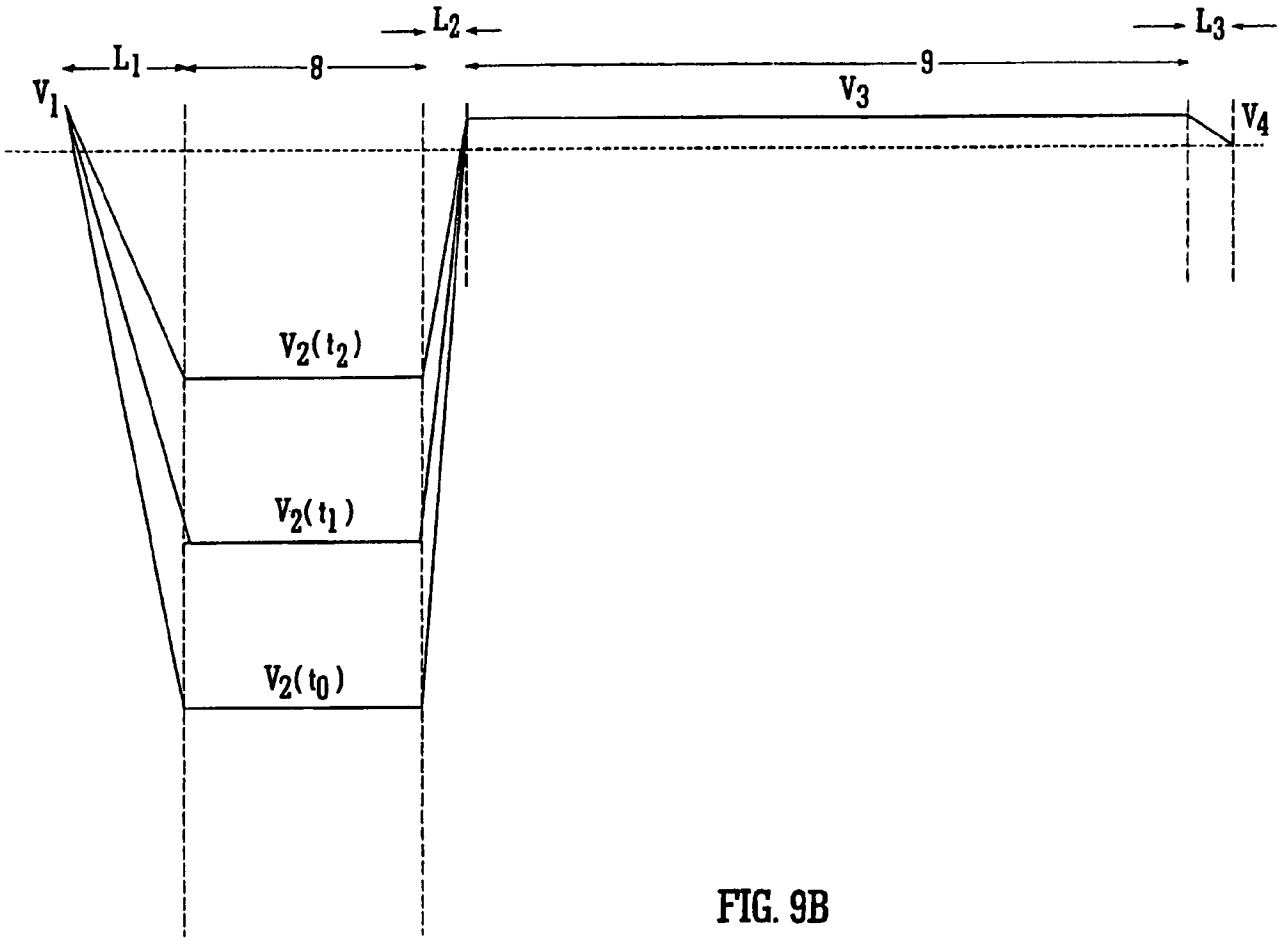
FIG. 9B illustrates the electric potential profile along a portion of the preferred mass spectrometer at three different points in time and FIG. 9C illustrates a preferred time-varying potential having a sinusoidal profile applied to a field free region according to a preferred embodiment.

FIG. 9B shows the electric potentials $V_1,V_2,V_3,V_4$ at which the target or sample plate 2, the initial field free region 8, the further field free region 9 and the acceleration region $L_3$ may be maintained at three subsequent points in time $t_0,t_1,t_2$ according to a preferred embodiment. In the preferred embodiment the potential $V_1$ of the target or sample plate 2 and the potential $V_3$ of the further field free region 9 are maintained constant with time and the potential $V_2$ of the initial field free region 8 (or more accurately the one or more electrodes forming the initial field free region 8) is varied with time. Preferably, the target or sample plate 2 and the further field free region 9 are maintained at positive DC potentials of, for example, +50 V and +25 V respectively. The target or sample plate 2 and the further field free region 9 may be maintained at other potentials according to other embodiments. The initial field free region 8 is preferably floated at a negative DC potential of, for example, −3.9 kV at an initial time $t_0$. The initial field free region 8 may be initially floated at other DC potentials according to other embodiments, for example −5 kV or −10 kV. A time varying potential is preferably applied to the initial field free region 8 (or more accurately the one or more electrodes forming the initial field free region 8) to generate a time-varying electric field $E_2$ in the further electric field region $L_2$ by virtue of the fact that the potential $V_3$ of the further field free region is remained fixed.

It can be seen from FIG. 9B that at an initial time to when the pulse of ions 3 is generated at the target or sample plate 2, the initial field free region 8 is preferably maintained at a relatively high negative potential $V_2(t_0)$ . The potential difference generated across the initial electric field region $L_1$ preferably accelerates the ions 3 such that they acquire substantially the same energy. Once the ions 3 have entered the initial field free region 8 with substantially the same energy then the ions 3 will preferably continue with velocities which are inversely proportional to the square root of their mass to charge ratio. The ions 3 will therefore become temporally separated according to their mass to charge ratio in the initial field free region 8 which will act as a time of flight region. Preferably, once substantially all of the ions 3 have passed into the initial field free region 8 a time varying potential may be effectively applied to the initial field free region 8, or more accurately to the one or more electrodes forming the initial field free region 8.

Ions 3 of different mass to charge ratios will pass through the initial field free region 8 with different velocities and hence will emerge into the further electric field region $L_2$ at substantially different times. As the potential $V_2$ of the initial field free region 8 is varied with time so the potential difference across the further electric field region $L_2$ and hence the strength of the retarding electric field $E_2$ in the further electric field region $L_2$ will vary with time since the potential $V_3$ is preferably maintained constant with time. Preferably, the potential $V_2$ of the initial field free region 8 becomes less negative with time at least until a time $t_1$ when substantially all of the ions 3 have exited the further electric field region $L_2$ and have entered the further field free region 9. Substantially all of the ions 3 therefore enter the further electric field region $L_2$ whilst the potential $V_2$ of the initial field free region 8 is between the initial potential $V_2(t_0)$ and the potential $V_2(t_1)$ at the time that substantially all of the ions 3 have emerged into the further field free region 9.

As the ions 3 preferably have substantially the same energy and become temporally separated in the initial field free region 8, ions of relatively low mass to charge ratio will exit the initial field free region 8 before ions having relatively higher mass to charge ratios. The ions of relatively low mass to charge ratio will therefore preferably enter the further electric field region $L_2$ whilst the potential $V_2$ of the initial field free region 8 is relatively highly negative. At the time when the relatively low mass to charge ratios ions enter the further electric field region $L_2$ the potential difference across the further electric field region $L_2$ is therefore preferably relatively high. Accordingly, the ions of relatively low mass to charge ratio will experience a relatively high strength retarding electric field in the further electric field region $L_2$ and hence these ions will be decelerated at a relatively high rate before they enter the further field free region 9 and pass therethrough at a constant velocity. Ions of relatively high mass to charge ratio will enter the further electric field region $L_2$ at a later time than the ions of relatively low mass to charge ratio. At this relatively later time the potential $V_2$ of the initial field free region 8 will preferably be less negative than the potential $V_2$ at the time when ions of relatively low mass to charge ratio entered into and passed through the further electric field region $L_2$. During the time when the ions having the highest mass to charge ratio enter into and pass through the further electric field region $L_2$ the potential difference across the further electric field region $L_2$ will therefore be relatively less negative. Accordingly, ions having a relatively high mass to charge ratio will therefore preferably experience a relatively low strength retarding electric field in the further electric field region $L_2$ and hence these ions will be decelerated at a relatively low rate before they enter the further field free region 9 at a time $t_1$ and pass therethrough at a constant velocity.

After substantially all of the ions 3 have passed through and exited the further electric field region $L_2$ the potential $V_2$ of the initial field free region 8 may continue to vary with time. For example, as shown in FIG. 9C the potential $V_2(t_2)$ at a later time $t_2$ may be even less negative but since the ions have already exited the further electric field region $L_2$ the potential $V_2(t_2)$ will have no effect upon the ions.

In the preferred embodiment, the time varying potential $V_2$ of the initial field free region 8 varies with time such that ions 3 having different mass to charge ratios are decelerated in the further electric field region $L_2$ by different rates or by different degrees such that ions having different mass to charge ratios arrive at the extraction or acceleration region 10 of the Time of Flight mass analyser at substantially the same time. In the preferred embodiment, the ions 3 of different mass to charge ratios are decelerated to slightly different velocities so that the ions of relatively high mass to charge ratio effectively catch up with the ions of relatively low mass to charge ratio so that substantially all of the ions 3 arrive at substantially the same location within the extraction or acceleration region 10 at substantially the same time.

Figure 9C:
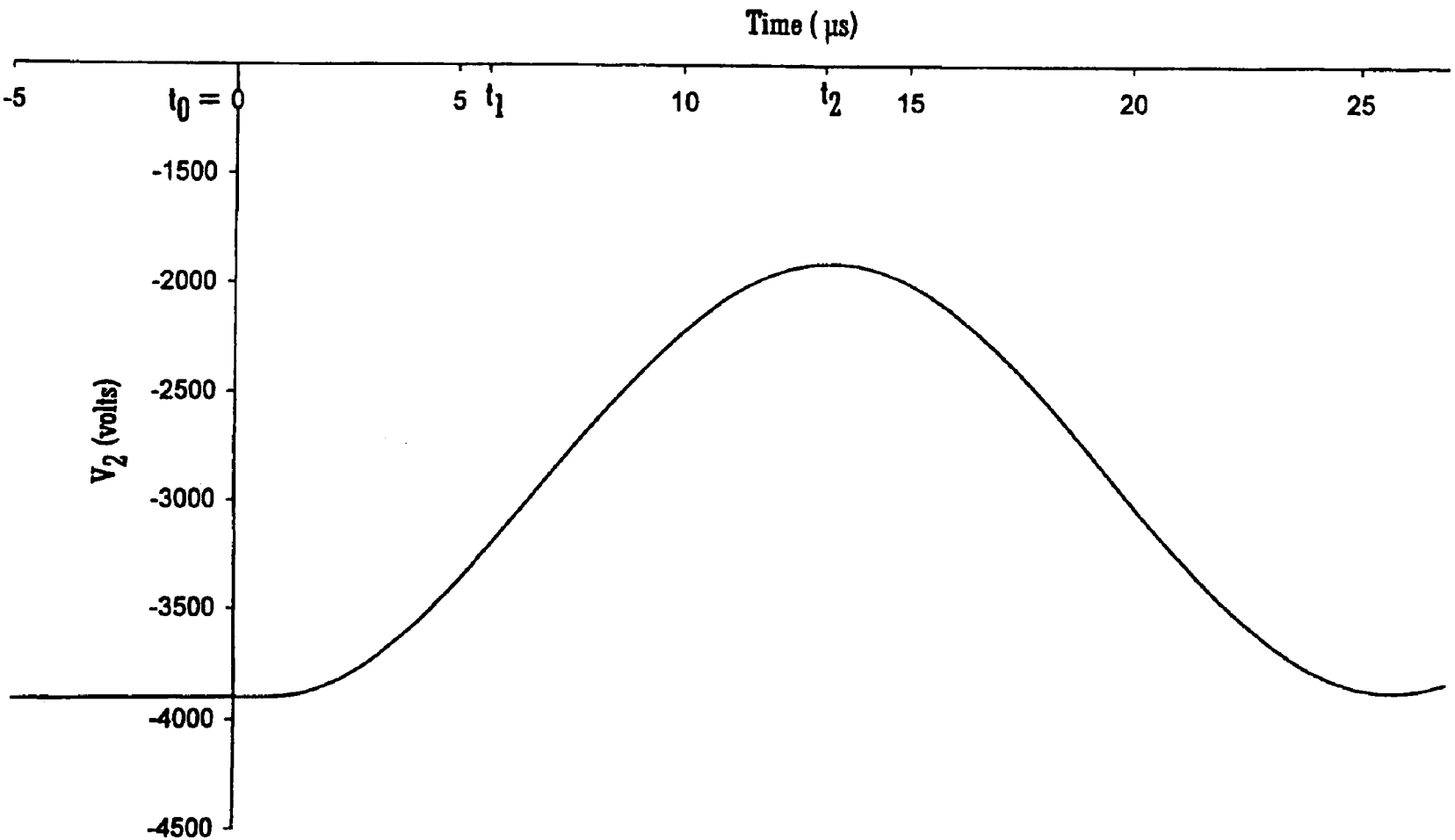

FIG. 9C shows an example of how the potential $V_2$ of the initial field free region 8 varies with time according to a preferred embodiment in which the target or sample plate 2 may be maintained at a fixed potential $V_1$ and the further field free region 9 may similarly be fixed at a potential $V_3$. In this embodiment the initial field free region 8 is preferably initially floated at a DC potential of −3.9 kV. A pulse of ions 3 is generated at the target or sample plate 2 of the ion source 1 substantially at an initial time $t_0$. At the time $t_0$ that the ions 3 are generated the initial field free region 8 is maintained at a potential $V_2(t_0)$ which is preferably the DC potential at which the initial field free region 8 is floated. Shortly after the pulse of ions 3 is generated, and preferably at a time when substantially all of the ions 3 have passed into the initial field free region 8 (or as this is occurring), a time-varying potential is effectively applied to the initial field free region 8. In this embodiment the time-varying potential applied to the initial field free region 8 varies substantially sinusoidally with time. Preferably, the time varying potential which is applied to the initial field free region 8 has a frequency of approximately 40 kHz, although in other embodiments the time varying potential may have different frequencies. The preferred range of frequencies of the time varying potential is from approximately 10 kHz to approximately 200 kHz. However, according to other embodiments other frequency time varying fields may be employed. In the preferred embodiment shown in FIG. 9C the sinusoidally time varying potential has a peak to peak amplitude of approximately 2 kV, although it is contemplated that time varying potentials applied to the initial field free region 8 may have other peak to peak amplitudes. In other embodiments, the peak to peak amplitude of the time varying potential may be larger than 2 kV and in an embodiment the peak to peak amplitude may be, for example, 3 kV.

In a preferred embodiment substantially all of the ions 3 have passed through and exited the initial field free region 8 and the further electric field region $L_2$ in less than about 10 μs. For example, in the particular embodiment illustrated with reference to FIG. 9C preferably all of the ions 3 have passed through the further electric field region $L_2$ by a time $t_1$ which is approximately 6 μs. Preferably, the ions 3 have certainly passed through and exited the initial field free region 8 and the further electric field region $L_2$ before the time $t_2$ at which the time-varying potential reaches its least negative value. It is contemplated therefore that the potential $V_2$ of the initial field free region 8 does not need to be continuously varied or cycled with time and in the embodiment shown in FIG. 9C preferably only a portion of the sinusoidally time-varying potential waveform up to a time $t_1$ is or needs to be applied to the initial field free region 8.

In a preferred embodiment, the electric fields $E_1$, $E_2$ arranged in the initial and further electric field regions $L_1$ and $L_2$ which may be provided within or adjacent to the ion source 1 may be controlled using software and electronics and may be arranged to produce ions 3 having either the same energy, a desired range of velocities and/or substantially the same velocity.

In another preferred embodiment a range of ions having different mass to charge ratios of interest may be arranged to arrive at the extraction or acceleration region 10 of an orthogonal acceleration Time of Flight mass analyser at a certain time whereas other undesired ions may be arranged to arrive at a different (e.g. earlier or later) time. The ion source 1 may be arranged to cause the ions of interest to have a slightly different velocity to the ions which are not required for analysis (such as matrix ions). In this embodiment substantially only ions of interest arrive at the extraction or acceleration region 10 of the orthogonal acceleration Time of Flight mass analyser at substantially the same time that an extraction pulse is applied to the extraction or acceleration region 10. The undesired matrix or background ions which arrive at a time when an extraction pulse is not applied are not therefore accelerated into the drift or flight region of the mass analyser.

Although the preferred embodiment relates to accelerating ions 3 of different mass to charge ratios to, preferably, to approximately similar velocities enabling an ion source 1 to be efficiently coupled to an extraction or acceleration region 10 of a Time of Flight mass analyser, it is also contemplated that the time varying electric fields may be suitable for efficiently transporting ions from or between other regions or devices in a mass spectrometer. For example, ions may be transported from a 2D or 3D ion trap to the extraction or acceleration region 10 of an orthogonal acceleration Time of Flight mass analyser or any other desired region. Alternatively, ions may be arranged to be transmitted to arrive at an ion trap at substantially the same time. In one embodiment the mass spectrometer may comprise an ion source such as a Matrix Assisted Laser Desorption Ionisation ("MALDI") ion source 1, means for collisional cooling ions and ion transportation means such as an AC or RF ion guide. Parent ions may be selected using, for example, a quadrupole mass filter or other form of mass filter. Fragmentation of parent ions may be achieved using a collision or fragmentation cell with or without RF or AC containment fields, followed by approximately constant velocity acceleration of parent and fragment ions into an extraction or acceleration region of a Time of Flight mass analyser.

Advantageously, because the ions 3 having different mass to charge ratios may be accelerated/decelerated to arrive at the desired portion of the extraction or acceleration region 10 at substantially the same time, the preferred embodiment enables the effective or required length of the extraction or acceleration region 10 in a MS mode of operation to be shorter compared to conventional extraction or acceleration regions 10 which are typically 10–50 mm long. The reduced length of the effective or required extraction or acceleration region 10 enables higher MS/MS parent ion resolution or specificity when the extraction or acceleration region 10 is used effectively as a timed ion gate or velocity selector. The effective length or size of the extraction or acceleration region 10 may be shortened using a switchable mechanical aperture (e.g. a sliding plate) arranged between the extraction or acceleration region 10 and the drift or flight region. Reducing the effective size or area of the effective extraction or acceleration area is particularly advantageous in a MS/MS mode of operation when a quadrupole or other mass filter is not used to select specific parent ions for fragmentation to increase the specificity with which parent ions and related fragment ions are orthogonally accelerated. The adjustable nature of the aperture allows the extraction or acceleration region 10 to be lengthened again when the mass analyser is operated in a MS mode of operation. In another embodiment the extraction or acceleration region 10 may comprise a plurality of extraction electrode segments. In this embodiment the effective axial length of the extraction or acceleration region 10 may be shortened or varied as desired, especially in a MS/MS mode of operation, by operating only some but not all of the extraction electrode segments.

Although the above preferred embodiments have been described utilising an orthogonal acceleration Time of Flight mass analyser, an axial Time of Flight mass analyser may alternatively be used instead according to less preferred embodiments.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

a first electric field region; and a Time of Flight mass analyser comprising an extraction or acceleration region;

wherein in a mode of operation a group of ions having substantially different mass to charge ratios is arranged to pass through said first electric field region, wherein a first electric field which varies with time is applied across at least a portion of said first electric field region such that at least some ions having substantially different mass to charge ratios are arranged to arrive at said extraction or acceleration region at substantially the same first time.

2. A mass spectrometer as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or substantially 100% of the ions in said group of ions are arranged to arrive at said extraction or acceleration region at substantially said same first time.

3. A mass spectrometer as claimed in claim 1, wherein said group of ions have a range of mass to charge ratios and wherein said range is at least 10, 50, 100, 150, 200, 250, 300, 350, 400, 450, 500, 550, 600, 650, 700, 750, 800, 850, 900, 950, 1000, 1100, 1200, 1300, 1400, 1500, 1600, 1700, 1800, 1900, 2000, 2500, 3000, 3500, 4000, 4500, 5000, 5500, 6000, 6500, 7000, 7500, 8000, 8500, 9000, 9500 or 10000 mass to charge ratio units.

4. A mass spectrometer as claimed in claim 1, wherein at least 5%, 10%, 15%, 20%, 25%, 30%, 35%, 40%, 45%, 50%, 55%, 60%, 65%, 70%, 75%, 80%, 85%, 90%, 95% or substantially 100% of said ions arriving at said extraction or acceleration region at substantially said same first time are subsequently extracted or accelerated from said extraction or acceleration region.

5. A mass spectrometer as claimed in claim 1, wherein in use at least some ions having a first mass to charge ratio enter said first electric field region with a first initial velocity and exit said first electric field region with a first final velocity and wherein in use at least some ions having a second different mass to charge ratio enter said first electric field region with a second initial velocity and exit said first electric field region with a second final velocity, wherein said first initial velocity is greater than said second initial velocity and said first final velocity is less than said second final velocity.

6. A mass spectrometer as claimed in claim 1, wherein ions having different mass to charge ratios enter in use said first electric field region with various initial velocities and exit said first electric field region with various final velocities, and wherein the ions having the fastest initial velocities are the ions which have the slowest final velocities.

7. A mass spectrometer as claimed in claim 1, wherein ions having different mass to charge ratios enter in use said first electric field region with various initial velocities and exit said first electric field region with various final velocities, and wherein the ions having the slowest initial velocities are the ions which have the fastest final velocities.

8. A mass spectrometer as claimed in claim 1, wherein in use at least some ions having different mass to charge ratios enter said first electric field region with a first range of velocities and exit said first electric field region with a second range of velocities, wherein said second range of velocities is substantially smaller than said first range of velocities.

9. A mass spectrometer as claimed in claim 1, wherein ions having a first mass to charge ratio exit said first electric field region before ions having a second mass to charge ratio, wherein said first mass to charge ratio is smaller than said second mass to charge ratio.

10. A mass spectrometer as claimed in claim 1, wherein said first electric field causes ions having a first mass to charge ratio to exit said first electric field region at a first velocity and ions having a second mass to charge ratio to exit said first electric field region at a second velocity.

11. A mass spectrometer as claimed in claim 10, wherein said second mass to charge ratio is greater than said first mass to charge ratio.

12. A mass spectrometer as claimed in claim 10, wherein said second velocity is greater than said first velocity.

13. A mass spectrometer as claimed in claim 12, wherein said second velocity is <1%, 1–5%, 5–10%, 10–15%, 15–20%, 20–25%, 25–30%, 30–35%, 35–40%, 40–45%, 45–50%, 50–55%, 55–60%, 60–65%, 65–70%, 70–75%, 75–80%, 80–85%, 85–90%, 90–95% or 95–100% greater than said first velocity.

14. A mass spectrometer as claimed in claim 12, wherein said second velocity is 100–200%, 200–300%, 300–400%, 400–500%, 500–600%, 600–700%, 700–800%, 800–900%, 900–1000%, 1000–2000%, 2000–3000%, 3000–4000%, 4000–5000%, 5000–6000%, 6000–7000%, 7000–8000%, 8000–9000%, 9000–10000% or >10000% greater than said first velocity.

15. A mass spectrometer as claimed in claim 10, wherein said second velocity is substantially equal to said first velocity.

16. A mass spectrometer as claimed in claim 1, wherein in use said first electric field causes undesired ions to arrive at said extraction or acceleration region at a second different time.

17. A mass spectrometer as claimed in claim 16, wherein at least some of said undesired ions arriving at said extraction or acceleration region at said second different time are not subsequently extracted or accelerated into said extraction or acceleration region.

18. A mass spectrometer as claimed in claim 16, wherein said undesired ions comprise matrix, background or interference ions.

19. A mass spectrometer as claimed in claim 1, wherein at least some of said ions having substantially different mass to charge ratios arriving at said extraction or acceleration region at substantially said same first time also arrive at substantially the same position or location within said extraction or acceleration region at said same first time.

20. A mass spectrometer as claimed in claim 1, wherein said first electric field region is arranged between at least a first electrode and a second electrode, and wherein the potential of either said first electrode and/or said second electrode is varied in use with time.

21. A mass spectrometer as claimed in claim 20, wherein said first electrode comprises one or more tubular electrodes and/or one or more plate electrodes and/or one or more grid electrodes.

22. A mass spectrometer as claimed in claim 20, wherein said second electrode comprises one or more tubular electrodes and/or one or more plate electrodes and/or one or more grid electrodes.

23. A mass spectrometer as claimed in claim 20, wherein said first electrode and/or said second electrode comprises: (i) one or more annular electrodes; (ii) one or more Einzel lens arrangements comprising three or more electrodes; (iii) one or more segmented rod sets; (iv) one or more quadrupole, hexapole, octapole or higher order rod sets; or (v) a plurality of electrodes having apertures through which ions are transmitted in use.

24. A mass spectrometer as claimed in claim 1, further comprising one or more electrodes arranged within said first electric field region, wherein the potential of at least one of said one or more electrodes is varied in use with time.

25. A mass spectrometer as claimed in claim 24, wherein said one or more electrodes comprises: (i) one or more tubular electrodes; (ii) one or more annular electrodes; (iii) one or more Einzel lens arrangements comprising three or more electrodes; (iv) one or more segmented rod sets; (v) one or more quadrupole, hexapole, octapole or higher order rod sets; or (vi) a plurality of electrodes having apertures through which ions are transmitted in use.

26. A mass spectrometer as claimed in claim 1, wherein the magnitude of said first electric field varies with time whilst ions pass through said first electric field region.

27. A mass spectrometer as claimed in claim 26, wherein the magnitude of said first electric field increases with time.

28. A mass spectrometer as claimed in claim 26, wherein the magnitude of said first electric field decreases with time.

29. A mass spectrometer as claimed in claim 26, wherein the magnitude of said first electric field varies substantially sinusoidally or cosinusoidally with time.

30. A mass spectrometer as claimed in claim 26, wherein the magnitude of said first electric field varies substantially exponentially with time.

31. A mass spectrometer as claimed in claim 26, wherein the magnitude of said first electric field varies substantially: (i) linearly with time; (ii) according to a square law ramp function with time; (iii) according to a cubic law ramp function with time; (iv) according to a power law ramp function with time; (v) according to a quadratic or higher order polynomial function with time; or (vi) according to a multiple stepped function with time.

32. A mass spectrometer as claimed in claim 1, wherein the direction of said first electric field is in a direction substantially parallel to the direction of ion travel.

33. A mass spectrometer as claimed in claim 1, wherein the direction of said first electric field changes whilst ions pass through said first electric field region.

34. A mass spectrometer as claimed in claim 1, wherein the length of said first electric field region is selected from the group consisting of: (i) <1 mm; (ii) 1–2 mm; (iii) 2–3 mm; (iv) 3–4 mm; (v) 4–5 mm; (vi) 5–6 mm; (vii) 6–7 mm; (viii) 7–8 mm; (ix) 8–9 mm; (x) 9–10 mm; and (xi) >10 mm.

35. A mass spectrometer as claimed in claim 1, wherein said first electric field acts to decelerate at least some of said ions passing through said first electric field region.

36. A mass spectrometer as claimed in claim 1, wherein said first electric field acts to accelerate at least some of said ions passing through said first electric field region.

37. A mass spectrometer as claimed in claim 1, further comprising a first field free region arranged downstream of said first electric field region.

38. A mass spectrometer as claimed in claim 37, wherein said first field free region is formed by one or more tubular electrodes and/or one or more plate electrodes.

39. A mass spectrometer as claimed in claim 37, wherein the length of said first field free region is selected from the group consisting of (i) ≦50 mm; (ii) ≧50 mm; (iii) ≧100 mm; (iv) ≧150 mm; (v) ≧200 mm; (vi) ≧250 mm; (vii) ≧300 mm; (viii) ≧350 mm; (ix) ≧400 mm; (x) ≧450 mm; and (xi) ≧500 mm.

40. A mass spectrometer as claimed in claim 37, further comprising a collision or fragmentation cell arranged in said first field free region.

41. A mass spectrometer as claimed in claim 40, wherein said collision or fragmentation cell comprises a tubular housing.

42. A mass spectrometer as claimed in claim 40, wherein ions are not confined radially within said collision or fragmentation cell by pseudo-potential wells.

43. A mass spectrometer as claimed in claim 40, wherein no AC or RF voltages are applied to said collision or fragmentation cell in order to provide radial confinement of ions.

44. A mass spectrometer as claimed in claim 40, further comprising an electrostatic energy analyser and/or mass filter and/or ion gate arranged upstream of said collision or fragmentation cell.

45. A mass spectrometer as claimed in claim 40, further comprising an electrostatic energy analyser and/or mass filter and/or ion gate arranged downstream of said collision or fragmentation cell.

46. A mass spectrometer as claimed in claim 44, wherein said mass filter comprises a magnetic sector mass filter, an RF quadrupole mass filter or a Wien filter.

47. A mass spectrometer as claimed in claim 1, further comprising a second electric field region arranged upstream of said first electric field region wherein in use a second electric field is maintained across at least a portion of said second electric field region.

48. A mass spectrometer as claimed in claim 47, wherein said second electric field remains substantially constant with time whilst ions pass through said second electric field region.

49. A mass spectrometer as claimed in claim 47, wherein said second electric field causes at least 10%, 20%, 30%, 40%, 50%, 60%, 70%, 80%, 90%, 95% or substantially 100% of ions passing through said second electric field region to exit said second electric field region with substantially the same kinetic energy.

50. A mass spectrometer as claimed in claim 47, wherein whilst ions pass through said second electric field region a potential difference is maintained across at least a portion of said second electric field region selected from the group consisting of: (i) <50 V; (ii) 50–100 V; (iii) 100–150 V; (iv) 150–200 V; (v) 200–250 V; (vi) 250–300 V; (vii) 300–350 V; (viii) 350–400 V; (ix) 400–450 V; (x) 450–500 V; (xi) 500–600 V; (xii) 600–700 V; (xiii) 700–800 V; (xiv) 800–900 V; (xv) 900–1000 V; (xvi) 1–2 kV; (xvii) 2–3 kV; (xviii) 3–4 kV; (xix) 4–5 kV; and (xx) >5 kV.

51. A mass spectrometer as claimed in claim 47, wherein the length of said second electric field region is selected from the group consisting of (i) <1 mm; (ii) 1–2 mm; (iii) 2–3 mm; (iv) 3–4 mm; (v) 4–5 mm; (vi) 5–6 mm; (vii) 6–7 mm; (viii) 7–8 mm; (ix) 8–9 mm; (x) 9–10 mm; and (xi) >10 mm.

52. A mass spectrometer as claimed in claim 47, wherein said second electric field is varied with time whilst ions pass through said second electric field region.

53. A mass spectrometer as claimed in claim 1, further comprising a second field free region arranged upstream of said first electric field region.

54. A mass spectrometer as claimed in claim 47, further comprising a second field free region arranged between said first electric field region and said second electric field region.

55. A mass spectrometer as claimed in claim 53, wherein said second field free region is formed by one or more tubular electrodes and/or one or more plate electrodes.

56. A mass spectrometer as claimed in claim 53, wherein at least some of the ions passing through said second field free region become spatially and/or temporally separated according to their mass to charge ratio.

57. A mass spectrometer as claimed in claim 53, wherein the length of said second field free region is selected from the group consisting of (i) <10 mm; (ii) 10–20 mm; (iii) 20–30 mm; (iv) 30–40 mm; (v) 40–50 mm; (vi) 50–60 mm; (vii) 60–70 mm; (viii) 70–80 mm; (ix) 80–90 mm; (x) 90–100 mm; and (xi) >100 mm.

58. A mass spectrometer as claimed in claim 1, further comprising an axial DC acceleration lens arranged upstream of said extraction or acceleration region.

59. A mass spectrometer as claimed in claim 1, wherein said extraction or acceleration region has a length selected from the group consisting of: (i) <1 mm; (ii) 1–2 mm; (iii) 2–3 mm; (iv) 3–4 mm; (v) 4–5 mm; (vi) 5–6 mm; (vii) 6–7 mm; (viii) 7–8 mm; (ix) 8–9 mm; (x) 9–10 mm; and (xi) >10 mm.

60. A mass spectrometer as claimed in claim 1, wherein the axial length of said extraction or acceleration region is adjustable.

61. A mass spectrometer as claimed in claim 1, wherein said extraction or acceleration region comprises a plurality of extraction or acceleration electrodes.

62. A mass spectrometer as claimed in claim 61, wherein in use the effective length of said extraction or acceleration region is adjusted by varying the number extraction or acceleration electrodes used to extract or accelerate ions.

63. A mass spectrometer as claimed in claim 1, further comprising an adjustable aperture, shutter or beam stop arranged between an extraction or acceleration electrode arranged in said extraction or acceleration region and a drift or flight region arranged downstream of said extraction or acceleration region, wherein in a mode of operation said adjustable aperture, shutter or beam stop substantially prevents or attenuates at least some ions which have been extracted or accelerated by said extraction or acceleration electrode from being transmitted into said drift or flight region.

64. A mass spectrometer as claimed in claim 63, wherein the size, area, diameter, length, width or transmission coefficient of said aperture, shutter or beam stop is adjustable.

65. A mass spectrometer as claimed in claim 63, wherein at least some parent ions are fragmented in use in a fragmentation or collision cell into fragment ions and wherein fragment ions and their corresponding parent ions exit said fragmentation or collision cell with substantially the same velocity and reach said extraction or acceleration electrode at substantially the same time.

66. A mass spectrometer as claimed in claim 63, wherein in said mode of operation multiple parent ions having different mass to charge ratios and their corresponding fragment ions are extracted or accelerated into said drift or flight region at the same time and wherein said adjustable aperture, shutter or beam stop substantially prevents or attenuates at least some parent ions and their corresponding fragment ions from being transmitted into said drift or flight region whilst substantially permitting or transmitting at least some other parent ions and their corresponding fragment ions into said drift or flight region.

67. A mass spectrometer as claimed in claim 1, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Laser Desorption Ionisation ("LDI") ion source; (v) an Inductively Coupled Plasma ("ICP") ion source; (vi) an Electron Impact ("EI") ion source; (vii) a Chemical Ionisation ("CI") ion source; (viii) a Field Ionisation ("FI") ion source; (ix) a Fast Atom Bombardment ("FAB") ion source; (x) a Liquid Secondary Ion Mass Spectrometry ("LSIMS") ion source; (xi) an Atmospheric Pressure Ionisation ("API") ion source; and (xii) a Field Desorption ("FD") ion source.

68. A mass spectrometer as claimed in claims 1, further comprising a Matrix Assisted Laser Desorption Ionisation ("MALDI") ion source.

69. A mass spectrometer as claimed in claim 1, further comprising a Desorption/Ionisation on Silicon ("DIOS") ion source.

70. A mass spectrometer as claimed in claim 1, further comprising a continuous ion source.

71. A mass spectrometer as claimed in claim 1, further comprising a pulsed ion source.

72. A mass spectrometer as claimed in claim 1, wherein said Time of Flight mass analyser comprises an orthogonal acceleration Time of Flight mass analyser.

73. A mass spectrometer as claimed in claim 1, wherein said Time of Flight mass analyser comprises an axial acceleration Time of Flight mass analyser.

74. A method of mass spectrometry comprising:

providing a first electric field region;

providing a Time of Flight mass analyser comprising an extraction or acceleration region; and varying a first electric field applied across at least a portion of said first electric field region such that ions having substantially different mass to charge ratios passing through said first electric field region are accelerated and/or decelerated such that ions having substantially different mass to charge ratios arrive at said extraction or acceleration region at substantially the same time.

75. A method as claimed in claim 74, wherein the magnitude of said first electric field varies with time whilst ions pass through said first electric field region.

76. A method as claimed in claim 74, wherein the magnitude of said first electric field increases with time.

77. A method as claimed in claim 74, wherein the magnitude of said first electric field decreases with time.

78. A method as claimed in claim 74, wherein the magnitude of said first electric field varies substantially sinusoidally or cosinusoidally with time.

* * * * *